US010166761B2

(12) United States Patent
Shibata

(10) Patent No.: US 10,166,761 B2
(45) Date of Patent: Jan. 1, 2019

(54) IMAGE FORMING APPARATUS AND IMAGE CORRECTING METHOD WITH CORRECTION TECHNOLOGY FOR IMPROVEMENT OF DEFECTIVE IMAGES

(71) Applicant: FUJIFILM Corporation, Tokyo (JP)

(72) Inventor: Hiroyuki Shibata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/470,919

(22) Filed: Mar. 28, 2017

(65) Prior Publication Data

US 2017/0282535 A1 Oct. 5, 2017

(30) Foreign Application Priority Data

Mar. 29, 2016 (JP) ..... 2016-065709

(51) Int. Cl.
*B41J 2/045* (2006.01)
*B41J 2/21* (2006.01)

(52) U.S. Cl.
CPC ..... *B41J 2/0451* (2013.01); *B41J 2/04586* (2013.01); *B41J 2/2139* (2013.01); *B41J 2/2142* (2013.01); *B41J 2/2146* (2013.01)

(58) Field of Classification Search
CPC ..... B41J 2/0451; B41J 2/04586
See application file for complete search history.

(56) References Cited

U.S. PATENT DOCUMENTS 7,316,464 B2 1/2008 Shibata et al.
8,851,619 B2 10/2014 Ueshima
9,218,645 B2 12/2015 Shibata
9,361,559 B2 6/2016 Shibata
2004/0252148 A1* 12/2004 Shibata ..... B41J 2/2139 347/14
2011/0227988 A1 9/2011 Yamazaki
2013/0293610 A1* 11/2013 Suzuki ..... B41J 2/04541 347/10

(Continued)

FOREIGN PATENT DOCUMENTS

JP 2005007613 1/2005
JP 2014144610 8/2014

(Continued)

*Primary Examiner* — Bradley Thies
(74) *Attorney, Agent, or Firm* — JCIPRNET

(57) ABSTRACT

A image forming apparatus includes: a device that detects abnormality of an image caused by abnormality of a nozzle in an inkjet head and a correcting device that performs correction by making a part of a plurality of nozzles non-ejectable based on a detection result of the abnormality and by compensating for it by another nozzle. The correcting device includes a plural non-ejection correcting device that performs correction by making two or more nozzles non-ejectable with respect to one abnormal nozzle and a single non-ejection correcting device that performs correction by making one abnormal nozzle non-ejectable with respect to the one abnormal nozzle. After a plural non-ejection correction is performed by making a nozzle group belonging to a nozzle range of a region including abnormality and including an abnormal nozzle non-ejectable, a single non-ejection correction is performed by making the abnormal nozzle non-ejectable.

13 Claims, 23 Drawing Sheets

(56) References Cited

U.S. PATENT DOCUMENTS

2014/0232772 A1 8/2014 Sasaki et al.

FOREIGN PATENT DOCUMENTS

| | | |
|---|---|---|
| JP | 2014159139 | 9/2014 |
| JP | 5597680 | 10/2014 |
| JP | 5725597 | 5/2015 |
| JP | 5791155 | 10/2015 |

* cited by examiner

4

START
PRINT JOB-SPECIFIED IMAGE
S111
S112
JOB CONTINUED?
No
Yes
TEST IMAGE
S113
S114
No
ABNORMALITY DETECTED?
Yes
S115
Yes
NOZZLE CAN BE SPECIFIED?
No
SELECT NOZZLE GROUP
S116
PLURAL NON-EJECTION CORRECTION
S117
S118
JOB CONTINUED?
No
Yes
TEST IMAGE
S119
S120
Yes
IS THERE IMAGE ABNORMALITY?
No
1
2
3

IMAGE FORMING APPARATUS AND IMAGE CORRECTING METHOD WITH CORRECTION TECHNOLOGY FOR IMPROVEMENT OF DEFECTIVE IMAGES

CROSS-REFERENCE TO RELATED APPLICATIONS

The present application claims priority under 35 U.S.C. § 119 to Japanese Patent Application No. 2016-065709, filed on Mar. 29, 2016. The above application is hereby expressly incorporated by reference, in its entirety, into the present application.

BACKGROUND OF THE INVENTION

Field of the Invention

The present invention relates to an image forming apparatus and an image correcting method and particularly to a correction technology suitable for improvement of defective images caused by abnormality of a nozzle in a single-path type ink-jet printing using a line head.

Description of the Related Art

In the field of digital printing which is one of image forming technologies, the single-path type inkjet printing apparatus has been put into practice. The single-path type inkjet printing apparatus completes printing by traversing an inkjet head in which a large number of nozzles are disposed with high density across a sheet only once. In this single-path inkjet printing method, if nozzle abnormalities such as non-ejection, bent ejection or the like occur in the inkjet head, a spot corresponding to a printed image forms a streak, which results in a problem that a printing quality is remarkably damaged. In order to solve this problem, there is a technology for correcting the nozzle abnormality.

An inkjet recording apparatus disclosed in Japanese Patent Application Laid-Open No. 2005-007613 includes a correcting device which applies subtraction processing to a multi-value data of a pixel corresponding to a nozzle whose ejection state is defective and a pixel in the vicinity thereof, and addition processing is applied with an amount according to the subtraction processing to the multi-value data of the pixel corresponding to the other nozzles recordable of a recording position by a nozzle whose ejection state is defective and a pixel in the vicinity thereof and then, binarization is applied to the multi-value data of the pixel.

An image forming apparatus disclosed in Japanese Patent Application Laid-Open No. 2014-159139 includes an obtaining device that determines a nozzle which is made non-ejection and obtains information indicating an abnormal nozzle based on a plurality of images formed by using the remaining nozzles other than the determined nozzle.

SUMMARY OF THE INVENTION

In order to carry out correction by the correcting method disclosed in Japanese Patent Application Laid-Open No. 2005-007613, an abnormal nozzle whose ejection state is defective needs to be accurately specified, but in the inkjet head in which a large number of nozzles are disposed with high density, ink can be applied from the plurality of nozzles to a same spot on a recording medium and thus, it is generally difficult to accurately specify the abnormal nozzle from a printing result of a user image. The user image means an image specified by the user as a target of a printing output. Thus, as one of methods for specifying the abnormal nozzle, the abnormal nozzle is specified by outputting a nozzle test pattern which is a test chart for testing the ejection states of the individual nozzles.

However, the abnormality of the nozzle does not necessarily have high reproducibility, and even if abnormality occurs on the user image printed on the recording medium, abnormality does not occur on a nozzle test pattern in some cases. Thus, even if occurrence of abnormality is grasped on the user image, the abnormal nozzle cannot be specified and thus, a streak defect cannot be corrected in some cases.

Therefore, in order to realize more appropriate correction, it is preferable that the abnormality can be detected on the user image and the abnormal nozzle can be specified at the same time. In order to solve these problems, use of the technology described in Japanese Patent Application Laid-Open No. 2014-159139 is considered.

By using the technology described in Japanese Patent Application Laid-Open No. 2014-159139, only when the abnormal nozzle is specified, a streak does not occur any more, and a streak occurs in the other cases. Whether there is a streak or not in the printed image can be clearly discriminated and a difference between the both can be read out and as a result, the abnormal nozzle can be specified on the user image.

However, if the technology described in Japanese Patent Application Laid-Open No. 2014-159139 is employed, it has the following problem. That is, in order to specify the abnormal nozzle, a nozzle which is made non-ejection should be sequentially switched. Since the streak continues to appear on the printed image until the abnormal nozzle is specified, a large number of waste sheets are generated. Particularly, if a reading resolution of an imaging device such as a scanner which reads the printing result is lower than a recording resolution of the image forming apparatus, specification of the abnormal nozzle is difficult, and an amount of the waste sheets further increases. Alternatively, it is likely that abnormality of the nozzle is no longer reproduced by the time when the abnormal nozzle is specified, and in that case, the abnormal nozzle cannot be specified.

The present invention was made in view of such circumstances and in order to provide methods for solving at least one of the aforementioned plurality of problems, it has an object to provide an image forming apparatus and an image correcting method which can carry out correction handling an abnormal nozzle while generation of a waste sheet is suppressed.

An image forming apparatus according to a first aspect of this disclosure includes: an inkjet head having a plurality of nozzles each ejecting a droplet; an image abnormality detecting device configured to detect abnormality of an image caused by abnormality of a nozzle of the plurality of nozzles from the image recorded on a recording medium by the inkjet head; and a correcting device configured to perform correction of lowering visibility of a missing portion by making a part of the plurality of nozzles non-ejectable and by compensating for the missing portion in the recorded image caused by the non-ejection by recording from another nozzle based on a detection result by the image abnormality detecting device, wherein: the correcting device includes: a plural non-ejection correcting device configured to perform correction by making two or more of the nozzles non-ejectable with respect to one abnormal nozzle; and a single non-ejection correcting device configured to perform correction by making one abnormal nozzle non-ejectable with respect to the one abnormal nozzle, and after a plural non-ejection correction is performed that carries out correction by making a nozzle group belonging to a nozzle range corresponding to a region including the abnormality detected by the image abnormality detecting device and including the abnormal nozzle non-ejectable by the plural non-ejection correcting device, a single non-ejection correction is performed which carries out correction by making the abnormal nozzle non-ejectable by the single non-ejection correcting device.

The nozzle group is a group of nozzles including two or more nozzles. According to the first aspect, when abnormality in an image is detected by the image abnormality detecting device, the plural non-ejection correction by the plural non-ejection correcting device is performed to the nozzle group which is a nozzle group included in a nozzle range in charge of recording of a region including the abnormality and also a nozzle group including the abnormal nozzle. By means of an effect of the plural non-ejection correction to the nozzle group including the abnormal nozzle, the abnormality in the image caused by the abnormality of the nozzle is improved early, and generation of a waste sheet can be suppressed. After that, by proceeding to the single non-ejection correction by the single non-ejection correcting device, excessive non-ejection can be solved.

In the image forming apparatus in the first aspect, the plural non-ejection correcting device may carry out the plural non-ejection correction which carries out the correction by making the nozzle group belonging to the nozzle range corresponding to the region including the abnormality detected by the image abnormality detecting device and also a nozzle group not including the abnormal nozzle non-ejectable. For example, there can be such an aspect that, before or after the plural non-ejection correction which carries out the correction by making the nozzle group including the abnormal nozzle non-ejectable is performed, the plural non-ejection correction which carries out the correction by making the nozzle group not including the abnormal nozzle non-ejectable is performed.

The term plural non-ejection correction is assumed to be used as a term expressing an operation of the correction involving making the nozzle group non-ejectable by the plural non-ejection correcting device whether or not the abnormal nozzle is included in the nozzle group which is to be made non-ejectable.

As a second aspect, in the image forming apparatus of the first aspect, assuming that a nozzle alignment direction in the inkjet head crossing a first direction that is a relative movement direction of the inkjet head and the recording medium when the image is to be recorded on the recording medium by the inkjet head is a second direction, the plural non-ejection correcting device performs correction by making a plurality of nozzles that are in an alignment order in the second direction of the nozzles non-ejectable and by lowering the visibility of the missing portion by using remaining nozzles other than the nozzles made non-ejectable.

A plurality of discontinuous nozzles means a plurality of nozzles selected at an interval of one nozzle or more. Specific examples of the plurality of discontinuous nozzles include a nozzle group of alignment every other nozzle, a nozzle group of alignment of every two nozzles or a nozzle group of alignment of every three nozzles, and an interval among nozzles in the nozzle group may be an equal nozzle interval or an unequal nozzle interval.

As a third aspect, in the image forming apparatus of a second aspect, when an integer nozzle number is given to each nozzle in accordance with an alignment order in the second direction of the nozzles in correspondence with a position of the nozzle in the second direction, the plural non-ejection correcting device is configured to make every other nozzle of the nozzles non-ejectable in the second direction and has an even-number nozzle group non-ejection correction mode in which a correction is performed by making the nozzle group with even nozzle numbers non-ejectable and an odd-number nozzle group non-ejection correction mode in which a correction is performed by making the nozzle group with odd nozzle numbers non-ejectable.

By dividing into two types of the nozzle groups, that is, the nozzle group with the even-number nozzle numbers and the nozzle group with the odd-number nozzle numbers, the abnormal nozzle is included in either one of these two types of the nozzle groups. Therefore, the abnormality in the image caused by the abnormal nozzle can be properly correction by either one of the correction by the even-number nozzle group non-ejection correction mode or the correction by the odd-number nozzle group non-ejection correction mode.

As a fourth aspect, in the image forming apparatus of any one of aspects from the first aspect to the third aspect, it may be so constituted that the image forming apparatus further includes: a nozzle group specifying device configured to specify a nozzle group including the abnormal nozzle; and a single nozzle specifying device configured to specify one abnormal nozzle, wherein the plural non-ejection correction is performed to the nozzle group specified by the nozzle-group specifying device, and the single non-ejection correction is performed to the abnormal nozzle specified by the single nozzle specifying device.

As a fifth aspect, in the image forming apparatus of the fourth aspect, it may be so constituted that, after the plural non-ejection correction is performed by the plural non-ejection correcting device or while the plural non-ejection correction is being performed, the abnormal nozzle is specified by the single nozzle specifying device.

According to the fifth aspect, even if time is required for specification of the abnormal nozzle, an amount of a waste sheet is small.

As a sixth aspect, in the image forming apparatus of the fifth aspect, it may be so constituted that, while the plural non-ejection correction is being performed by the plural non-ejection correcting device, processing of specifying the abnormal nozzle is executed by the single nozzle specifying device; and when the abnormal nozzle is specified, the plural non-ejection correction is switched to the single non-ejection correction by the single non-ejection correcting device.

As a seventh aspect, in the image forming apparatus of any one of aspects from the fourth aspect to the sixth aspect, it may be so constituted that the nozzle group specifying device specifies in which nozzle group the abnormal nozzle is included in a plurality of the nozzle groups different from each other.

As an eighth aspect, in the image forming apparatus of the seventh aspect, it may be so constituted that the nozzle-group specifying device specifies the nozzle group including the abnormal nozzle by changing a nozzle group which is to be made non-ejectable by the plural non-ejection correcting device and by analyzing an image obtained by performing the correction by the plural non-ejection correcting device.

As a ninth aspect, in the image forming apparatus of the seventh aspect, it may be so constituted that the nozzle group specifying device specifies the nozzle group including an abnormal nozzle based on a first test chart recorded for each nozzle group.

As a tenth aspect, in the image forming apparatus of any one of the seventh aspect to the ninth aspect, it may be so constituted that the image forming apparatus includes a plurality of the inkjet heads having different colors of ink to be ejected are provided, and the plurality of nozzle groups different from each other include those with different colors of ink to be ejected among the nozzle groups.

When abnormality in an image is detected, it is desirable to grasp a color of a nozzle in the inkjet head the abnormality occurs. According to the tenth aspect, the nozzle group including the abnormal nozzle is specified in the nozzle groups with different colors.

As an eleventh aspect, in the image forming apparatus of any one of the fourth aspect to the tenth aspect, it may be so constituted that the single nozzle specifying device records a second test chart for specifying the abnormal nozzle on a nozzle test region provided outside the user image region of the recording medium and specifies the abnormal nozzle based on a recording result of the second test chart.

As a twelfth aspect, in the image forming apparatus of any one of the fourth aspect to the tenth aspect, it may be so constituted that the single nozzle specifying device specifies the abnormal nozzle by sequentially cancelling non-ejection of the non-ejection nozzle which was made non-ejectable in the plural non-ejection correction by the plural non-ejection correcting device one by one and by detecting abnormality in the image after the respective correction.

As a thirteenth aspect, in the image forming apparatus of any one of the fourth aspect to the twelfth aspect, it may be so constituted that, if specification of the abnormal nozzle by the single nozzle specifying device is not possible, correction by the plural non-ejection correcting device is cancelled.

According to the thirteenth aspect, after the abnormality in the image is detected, if the abnormality is not reproduced any more due to recovery of the abnormality of the nozzle or the like, correction by the plural non-ejection correcting device is cancelled. As a result, useless non-ejection is solved.

An image correcting method according to a fourteenth aspect includes: an image abnormality detection step of detecting abnormality of an image caused by abnormality of a nozzle of the plurality of nozzles from the image recorded on a recording medium by having a droplet to be ejected from a plurality of nozzles included in an inkjet head; and a correction step of performing correction of lowering visibility of a missing portion by making a part of the nozzles in the plurality of nozzles non-ejectable and by compensating for the missing portion in the recorded image caused by the non-ejection by recording from another nozzle based on a detection result by the image abnormality detection step, wherein the correction step includes: a plural non-ejection correction step of carrying out correction by making two or more of the nozzles non-ejectable with respect to one abnormal nozzle; and a single non-ejection correction step of carrying out correction by making one abnormal nozzle non-ejectable with respect to the one abnormal nozzle, and after a plural non-ejection correction is performed which carries out correction by making a nozzle group belonging to a nozzle range corresponding to a region including the abnormality detected by the image abnormality detection step and including the abnormal nozzle non-ejectable by the plural non-ejection correction step, a single non-ejection correction is performed which carries out correction by making the abnormal nozzle non-ejectable by the single non-ejection correction step.

In the fourteenth aspect, a matter similar to the matter specified in the first aspect to the thirteenth aspect can be combined as appropriate. In that case, the element of the device or the function specified in the image forming apparatus can be grasped as an element of processing or a step of an operation corresponding to that.

According to the present invention, generation of a waste sheet is suppressed, and correction handling the abnormal nozzle can be made.

DETAILED DESCRIPTION OF THE EMBODIMENTS

An embodiment of the present invention will be described below in detail by referring to the attached drawings.

[Streak Defect of Line-Head Type Inkjet Printing Apparatus]

Figure 1:
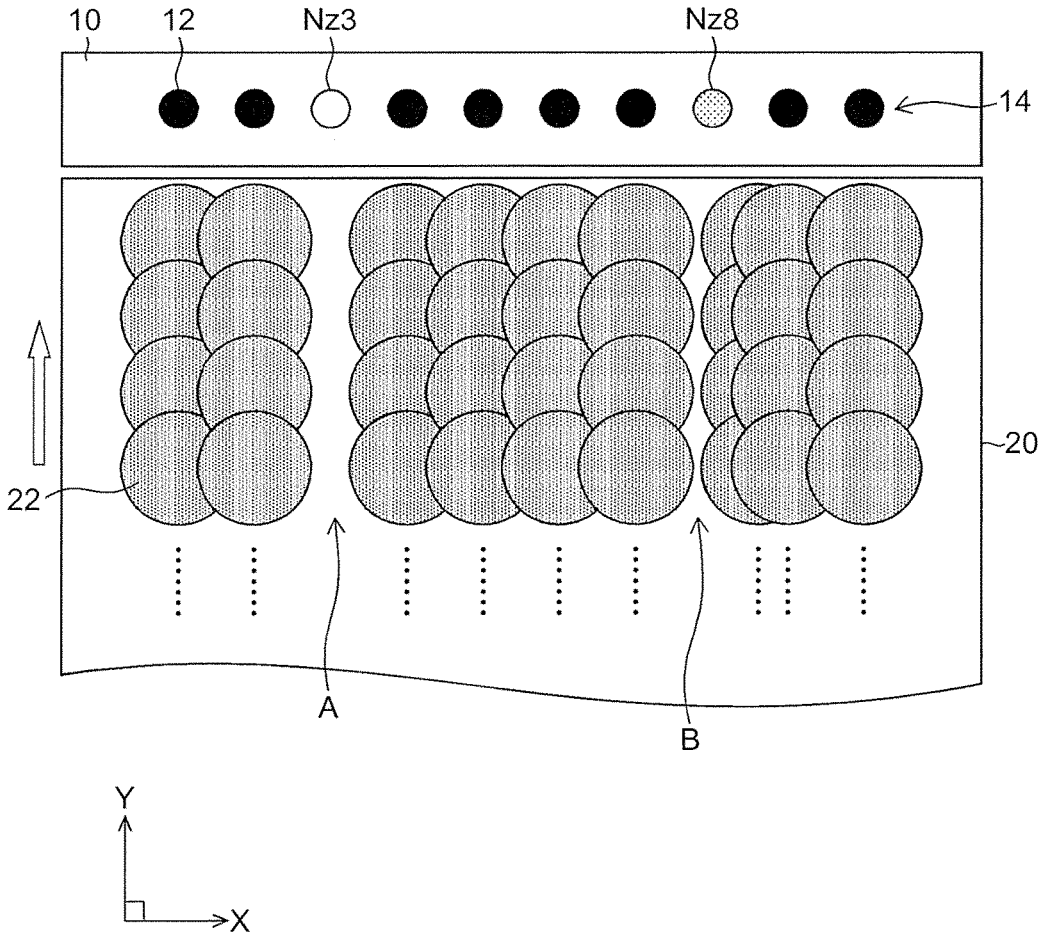
FIG. 1 is a schematic diagram for explaining a streak defect caused by an abnormal nozzle in a line-head type inkjet printing apparatus.

FIG. 1 is a schematic diagram for explaining a streak defect caused by an abnormal nozzle in a line-head type inkjet printing apparatus. The line-head type inkjet printing apparatus refers to an inkjet printing apparatus including a line head. Here, for simplification of the description, a monochromic grayscale image will be described as an example.

A line head 10 is an inkjet head having a nozzle row 14 in which a plurality of nozzles 12 which eject ink in an inkjet method is aligned. By conveying a medium 20 with respect to the line head 10 and by ejecting an ink droplet from the nozzle 12, the ink droplet is deposited onto the medium 20, and a dot 22 is recorded.

It is assumed that a medium conveyance direction which is a direction in which the medium 20 is conveyed with respect to the line head 10 is a Y-direction, and a medium width direction which is a width direction of the medium 20 orthogonal to the Y-direction is an X-direction. The plurality of nozzles 12 of the line head 10 is aligned in the X-direction, and each of the nozzles 12 is in charge of recording at a different position in the X-direction of the medium 20. The X-direction which is an alignment direction of the nozzle 12 is called a nozzle-row direction in some cases.

The medium conveyance direction is a direction in which the line head 10 is made to traverse relatively to the medium 20 and is called a traverse direction in some cases. Moreover, the X-direction is called a traverse orthogonal direction in some cases. The medium 20 is an example of a recording medium. The Y-direction is an example of a relative movement direction. The Y-direction is an example of a first direction, and the X-direction is an example of a second direction. Here, by conveying the medium 20 with respect to the line head 10, the both make relative movement, but such constitution that by moving the line head 10 with respect to the medium 20, the line head 10 and the medium 20 are made to move relatively may be employed.

FIG. 1 exemplifies a nozzle row 14 in which ten nozzles 12 are aligned. As an example of an abnormal nozzle, a No. 3 nozzle Nz3 which is the third from the left in FIG. 1 is a non-ejection nozzle. Moreover, an example in which bent ejection occurs in No. 8 nozzle Nz8 which is the eighth from the left is shown. The non-ejection nozzle is a nozzle which cannot eject ink. The term "non-ejection" has the same meaning as the term "non-ejectable". The term "abnormality" may read "defect".

The term bent ejection is a phenomenon in which an ejection direction of the droplet is departed, and a position where a dot is actually formed is shifted from an ideal position where the dot should be formed. The ideal position where the dot should be formed is a target position on design and refers to a dot forming position assumed when a normal nozzle ejects a droplet.

In the case of a situation illustrated in FIG. 1, a streak defect extending in the Y-direction occurs at a position A on the medium 20 corresponding to the position of the No. 3 nozzle Nz3 which is an abnormal nozzle. Moreover, a streak defect extending in the Y-direction occurs at a position B on the medium 20 corresponding to the position of the No. 8 nozzle Nz8 which is an abnormal nozzle. The streak defect refers to a streak-like image defect. The streak defect includes also a discontinuous streak in addition to a continuous streak. The streak defect is called simply a "streak" in some cases.

In a single-path type inkjet printing apparatus which moves the medium 20 relatively to the line head 10 and completes recording of an image with specified recording resolution in one traversing, a streak extending in a traverse direction occurs on a printed image by the abnormal nozzle.

Outline of Embodiment

The image forming apparatus according to the embodiment is a single-path type inkjet printing apparatus including a line head and includes an image abnormality detecting device which detects abnormality in an image caused by abnormality of a nozzle and a correcting device which performs correction so that a non-ejection portion is made invisible by making the nozzle non-ejectable.

The correcting device in this embodiment is constituted by including a single non-ejection correcting device and a plural non-ejection correcting device. The single non-ejection correcting device is a device which makes correction by making one specified abnormal nozzle non-ejectable with respect to abnormality of one nozzle. The plural non-ejection correcting device is a device which makes correction by making two or more nozzles non-ejectable with respect to abnormality of one nozzle. A collection of two or more nozzles is called a nozzle group.

The term "making non-ejectable" refers to processing of forcedly bringing the nozzle into a state where use is prohibited. The nozzle made non-ejectable enters a state where it cannot eject a droplet and is made a non-ejectable nozzle. The term "non-ejection" can be expressed as "ejection-disabled" or "non-usable". The nozzle made non-ejectable is called a non-ejectable nozzle.

Correction of making the non-ejectable portion invisible refers to correction of lowering visibility of a streak so that the streak which occurred since the nozzle is made non-ejectable in printing is not conspicuous. The non-ejection portion is a missing portion where record is missing due to non-ejection. In the case of the single-path type, the non-ejection portion becomes a streak. That is, the correcting device in this embodiment makes correction which lowers visibility of the missing portion by compensating for the missing portion of the record due to non-ejection by recording from another nozzle by making a part of the nozzles in the plurality of nozzles non-ejectable. A correcting technology which improves an image defect of a streak caused by the non-ejection nozzle is called "non-ejection correction". The correcting device in this embodiment can be understood as a device which makes non-ejection correction.

An operation mode in which correction is performed by the single non-ejection correcting device is called a single non-ejection correction mode. An operation mode in which correction is performed by the plural non-ejection correcting device is called a plural non-ejection correction mode. The correcting device in this embodiment can make two types of correction, that is, the single non-ejection correction mode and the plural non-ejection correction mode. In this embodiment, an example of a specific operation in which the two types of correction are used separately is as follows. That is, if one abnormal nozzle cannot be specified in the image abnormality detecting device in a state where abnormality in an image caused by nozzle abnormality occurs, the plural non-ejection correction mode in which correction is performed by making a nozzle group belonging to a nozzle range corresponding to a region including the abnormality non-ejectable is used.

Moreover, the correcting device has a nozzle group specifying device which specifies a nozzle group including the abnormal nozzle and a single nozzle specifying device which specifies one abnormal nozzle in the specified nozzle group, and when one abnormal nozzle is specified by the single nozzle specifying device, non-ejection of a nozzle which is not an abnormal nozzle in the nozzle group made non-ejectable in the plural non-ejection correction mode is canceled based on a specification result of the abnormal nozzle. Then, correction in the single non-ejection correction mode is applied to the specified abnormal nozzle.

When a nozzle corresponding to an abnormal spot of an image is to be specified, in a process required for specifying one nozzle and a process required for specifying a nozzle group, the latter can be usually executed in a shorter process. For example, consider a case in which an abnormal spot of an image is found in a read-out image obtained from a scanner, and an abnormal nozzle which causes the image abnormality is to be specified. As a specific example, assuming that recording resolution of the line head is 1200 dpi and resolution of a scanner which reads a print result is 400 dpi, landing points for 3 nozzles are included in 1 pixel of the scanner. The term "dpi" means dot per inch and is a unit notation representing the number of dots (points) per inch. 1 inch equals to 25.4 millimeter [mm]. Since a dot of one pixel can be recorded by one nozzle, the recording resolution dpi can be understood by replacing it with npi. The term "npi" means nozzles per inch and is a unit notation representing the number of nozzles per inch. The recording resolution has the same meaning as print resolution.

Assuming that a detected region including abnormality is a range for 2 pixels on the read-out image, the number of candidate nozzles which are suspected to be abnormal nozzles causing the image abnormality is six. If the number of candidates of the abnormal nozzles is 6 nozzles, five waste sheets at the maximum are generated for specifying one truly abnormal nozzle in the six candidate nozzles by using the technology of Japanese Patent Application. Laid-Open No. 2014-159139.

On the other hand, in the image forming apparatus according to this embodiment, first, the nozzle group including the abnormal nozzle is specified, and the correction is performed in the plural non-ejection correction mode by the unit of the nozzle group including the abnormal nozzle. Early functioning of the correction by the plural non-ejection correction mode suppresses generation of waste sheets. After that, while the non-ejection correction by the unit of the nozzle group is performed in the plural non-ejection correction mode, the abnormal nozzle can be specified.

As an example of a specifying method of the nozzle group by the nozzle group specifying device, such configuration that a nozzle range of the plurality of candidate nozzles including the abnormal nozzle is divided into two types of nozzle groups, that is, a nozzle group with even-number nozzle numbers and a nozzle group with odd-number nozzle numbers can be employed. The nozzle group with the even-number nozzle numbers is called an even-number nozzle group, and the nozzle group with an odd-number nozzle numbers is called an odd-number nozzle group. The abnormal nozzle is included in either one of the even-number nozzle group and the odd-number nozzle group.

That is, when the nozzle group to which the abnormal nozzle belongs is to be specified, if the nozzle groups are divided into two types of nozzle groups, that is, the even-number nozzle group and the odd-number nozzle group, which nozzle group the abnormal nozzle is included in can be specified by two sheets of printed matter, that is, a print result obtained by applying the plural non-ejection correction mode to the even-number nozzle group and the print result obtained by applying the plural non-ejection correction mode to the odd-number nozzle group, and since one of the two has been properly corrected, the number of waste sheet generated in this case can be only one.

After that, the correction to the nozzle group including the abnormal nozzle is made and while the printing is continued, processing of specifying a single truly abnormal nozzle is carried out and thus, a waste sheet is not generated due to the effect of the correction in the plural non-ejection correction mode. However, when the single truly abnormal nozzle is to be specified in the nozzle group including the abnormal nozzle, in order to specify the single abnormal nozzle on the user image, in trials performed by sequentially switching the nozzle for which non-ejection is to be cancelled, one of the trials can cancel non-ejection of the abnormal nozzle. Thus, one waste sheet can be additionally generated. However, the generation of the waste sheet can be largely decreased as compared with the conventional method described in Japanese Patent Application Laid-Open No. 2014-159139.

Thus, by applying the image correcting method according to the embodiment, even in the case of reading at such low resolution that the abnormal nozzle cannot be specified in one session or even in the case of employment of a testing method not using a special test chart which can specify the abnormal nozzle, a streak caused by the abnormal nozzle can be corrected without generating a large number of waste sheets.

[First Example of Image Correcting Method]

Figure 2:
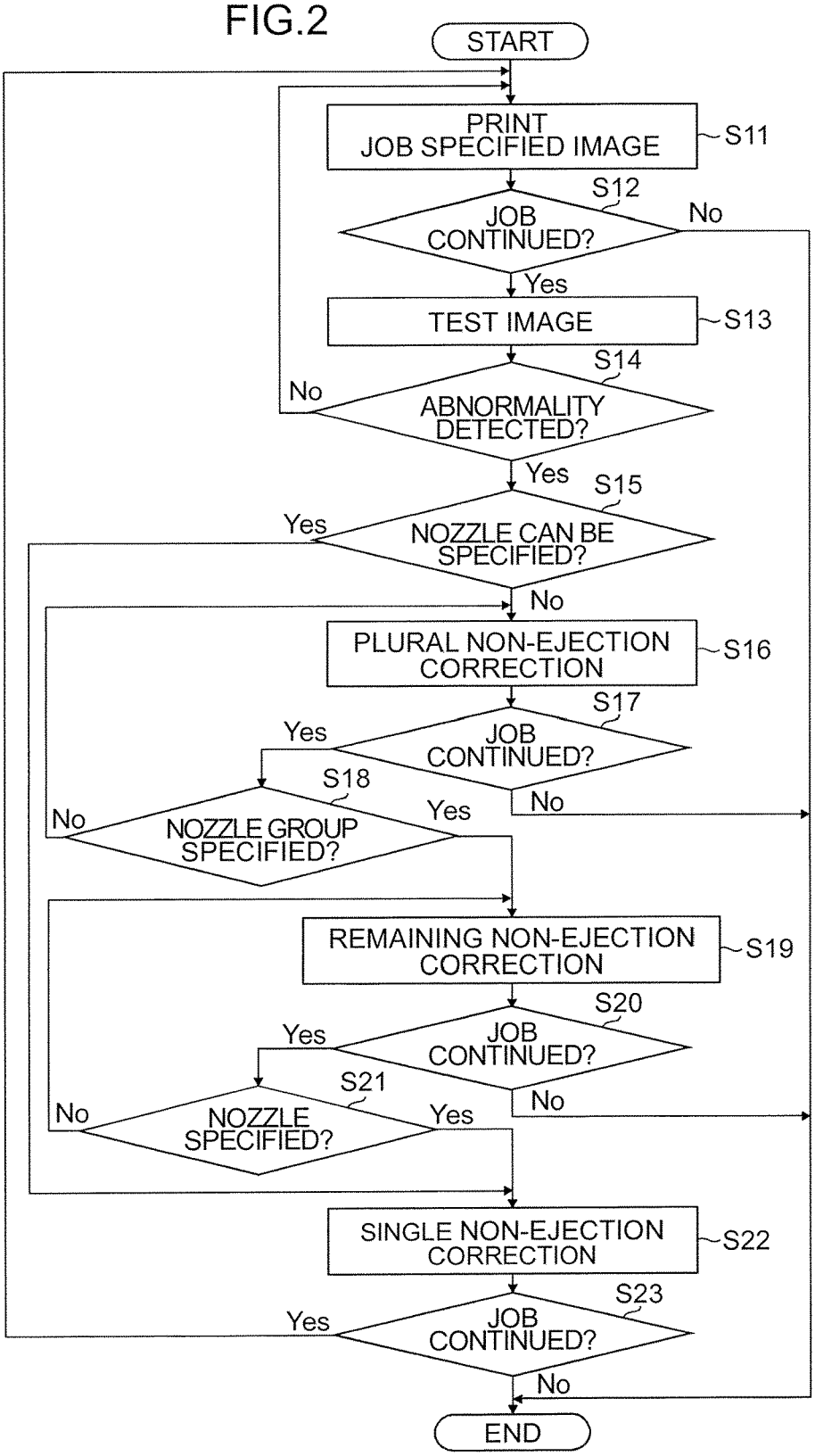
FIG. 2 is a flowchart illustrating a procedure of a first example of an image correcting method in an image forming apparatus according to an embodiment.

FIG. 2 is a flowchart illustrating a procedure of a first example of the image correcting method in an image forming apparatus according to the embodiment. The flowchart in FIG. 2 is an example of an operation of carrying out detection of abnormality in an image during execution of a job of printing a plurality of user images and correction for making a streak invisible.

Each step in the flowchart illustrated in FIG. 2 is executed by the inkjet printing apparatus including a controller. The inkjet printing apparatus includes a scanner which reads an image after printing. The controller is constituted by including an image processing device which processes a user image specified as a target of print output and a read-out image obtained from the scanner. The image processing device executes various types of signal processing including processing of detecting abnormality in the printed image, processing of specifying a nozzle group including the abnormal nozzle, processing of specifying the abnormal nozzle, correction processing in the plural non-ejection correction mode, and correction processing in the single non-ejection correction mode.

The controller can be constituted by a combination of hardware and software of a computer, for example. A part of or the whole of a processing function of the image processing device may be realized by an integrated circuit. The software has the same meaning as a "program". The controller realizes the operations in the flowchart in FIG. 2 by executing the program.

When a job is started, at Step S11, the inkjet printing apparatus prints an image according to specification of the job. Step S11 is a normal printing step in which the job is executed and printing is carried out.

At Step S12, the controller determines whether the job is to be continued or not. At Step S12, if the controller determines that the job is to be continued, the routine proceeds to Step S13.

At Step S13, the image processing device carries out an image test which tests whether the image after printing has abnormality or not. If abnormality occurs in a nozzle, abnormality in the image is detected by an image testing step at Step S13. Step S13 corresponds to a mode of an "image abnormality detection step".

At Step S14, the controller determines presence of abnormality in the image based on a test result of the image testing step at Step S13. If abnormality is not detected in the image by the image testing step, it is determined to be "no abnormality" at Step S14, and the routine returns to Step S11 in this case.

On the other hand, if abnormality is detected in the image by the image testing step, it is determined to be "abnormal" at Step S14, and the routine proceeds to Step S15 in this case.

At Step S15, the controller determines whether the abnormal nozzle can be specified or not. If the abnormal nozzle which causes the abnormality can be specified without carrying out subsequent printing, the determination at Step S15 becomes Yes determination, and the routine proceeds to Step S22.

At Step S22, the inkjet printing apparatus makes the single non-ejection correction which corrects a streak by making one specified abnormal nozzle non-ejectable and prints the corrected image. The single non-ejection correction step at Step S22 includes an operation of carrying out signal processing required for the correction and an operation of printing the image.

On the other hand, at Step S15, if it is impossible to specify the abnormal nozzle which causes the abnormality without carrying out the subsequent printing, it becomes No determination at Step S15, and the routine proceeds to Step S16.

At Step S16, the inkjet printing apparatus preforms the plural non-ejection correction which makes a nozzle group of a region including the abnormality non-ejectable and makes the non-ejection portion invisible and prints the corrected image. The plural non-ejection correction step at Step S16 includes the operation of carrying out signal processing required for the correction and the operation of printing the image.

At Step S17, the controller determines whether the job is to be continued or not. At Step S17, if the controller determines that the job is to be continued, the routine proceeds to Step S18.

At Step S18, the controller determines whether the nozzle group including the abnormal nozzle can be specified or not. For example, the controller determines whether the abnormal nozzle is included in the nozzle group made non-ejectable by the plural non-ejection correction processing at Step S16 or not from the test result of the image printed by the plural non-ejection correction step at Step S16.

If the abnormal nozzle is not included in the nozzle group made non-ejectable at Step S16, the image printed by Step S16 becomes a defective image with a streak remained. In this case, the nozzle group including the abnormal group is unspecified, and the determination at Step S18 becomes No determination.

In the case of the No determination at Step S18, the routine returns to Step S16, the nozzle group to be made non-ejectable is changed, and the correction is performed in the plural non-ejection correction mode, and the corrected image is printed. For example, if a streak remains when the nozzle group with odd-number nozzle numbers is made non-ejectable and the plural non-ejection correction is performed, the non-ejection of the nozzle group with the odd-number nozzle numbers is cancelled, and the correction in the plural non-ejection correction mode is performed by making the nozzle group with the even-number nozzle numbers non-ejectable, and the corrected image is printed.

On the other hand, if the abnormal nozzle is included in the nozzle group made non-ejectable at Step S16, the image printed by Step S16 becomes a favorable image with the streak corrected. In this case, the nozzle group including the abnormal nozzle is specified, and the determination at Step S18 becomes the Yes determination.

A processing loop from Step S16 to Step S18 includes a process of nozzle-group search print which searches a nozzle group including the abnormal nozzle. That is, Step S16 to Step S18 correspond to a step of nozzle-group specification processing of specifying a nozzle group including the abnormal nozzle. By the nozzle-group specification processing from Step S16 to Step S18, the nozzle group including the abnormal nozzle is specified, and the plural non-ejection correction which makes the specified nozzle group non-ejectable is performed.

At a stage where the determination at Step S18 is the Yes determination, the abnormality of the image caused by the abnormal nozzle has been already corrected, and a waste sheet is not generated any more by the effect of the plural non-ejection correction mode. If it is Yes determination at Step S18, the routine proceeds to Step S19.

From Step S19 to Step S21, the inkjet printing apparatus carries out processing of specifying the abnormal nozzle in the nozzles of the specified nozzle group.

At Step S19, the inkjet printing apparatus selects one nozzle which has not been confirmed to be a nozzle without abnormality from the nozzles in the nozzle group specified at Step S18, cancels non-ejection of the selected single nozzle and makes remaining non-ejection correction of making the non-ejection portion invisible while the non-ejection of the remaining nozzles in the same nozzle group is maintained. If there are two or more remaining nozzles, the remaining non-ejection correction is correction in the plural non-ejection correction mode. If there is one remaining nozzles, the remaining non-ejection correction is correction in the single non-ejection correction mode. The remaining non-ejection correction step at Step S19 includes the operation of carrying out signal processing required for the correction and the operation of printing the image.

At Step S20, the controller determines whether the job is to be continued or not. At Step S20, if the controller determines that the job is to be continued, the routine proceeds to Step S21.

At Step S21, the controller determines if the abnormal nozzle can be specified or not. For example, the controller determines whether the nozzle for which non-ejection was cancelled in the processing of the remaining non-ejection correction at Step S19 is the abnormal nozzle or not from the test result of the image printed by the remaining non-ejection correction step at Step S19.

If there is no abnormality in the image printed by Step S19, it is determined that the nozzle for which the non-ejection was cancelled is not an abnormal nozzle. On the other hand, if there is abnormality of a streak in the image printed by Step S19, the nozzle for which the non-ejection was cancelled is specified to be an abnormal nozzle.

At Step S21, if the controller determines that the abnormal nozzle has not been specified, the routine returns to Step S19, and non-ejection of another nozzle is cancelled, and the remaining non-ejection correction is performed.

During a period of the processing from Step S19 to Step S21, an unconfirmed nozzle which has not been confirmed to be a nozzle without abnormality in the nozzles belonging to the nozzle group specified at Step S18 remains non-ejectable in principle, and the non-ejection correction corresponding to the non-ejection effectively functions. However, in order to specify the abnormal nozzle in the nozzle group, non-ejection is exceptionally cancelled for the one nozzle selected on a trial basis.

Therefore, during the period of the processing from Step S19 to Step S21, the streak caused by the abnormal nozzle is corrected in principle, and abnormality does not occur in the image due to the effect of the correction. As an exception, when the abnormal nozzle is to be specified, a streak occurs in the image printed after making the remaining non-ejection correction in the state where the non-ejection of the abnormal nozzle is cancelled.

Regarding the nozzle which is confirmed not to have abnormality in a process of the processing from Step S19 to Step S21, non-ejection is cancelled, and a normal printable state is restored.

The processing loop from Step S19 to Step S21 includes a process of single nozzle search print which searches an abnormal nozzle. That is, Step S19 to Step S21 correspond to a step of single-nozzle specification processing of specifying the abnormal nozzle. By the single-nozzle specification processing from Step S19 to Step S21, the abnormal nozzle is specified.

At Step S21, when the controller determines that the abnormal nozzle could be specified, the routine proceeds to Step S22, and the correction in the single non-ejection correction mode is performed. In this way, only the abnormal nozzle is made non-ejectable and corrected in the end. The single non-ejection correction step at Step S21 includes the operation of carrying out signal processing required for the correction and the operation of printing the image.

At Step S23, the controller determines whether the job is to be continued or not. At Step S23, when the controller determines that the job is to be continued, the routine returns to Step S11.

When the routine returns from Step S23 to Step S11, the single non-ejection correction at Step S22 is maintained after that, and the processing from Step S11 to Step S23 is carried out to occurrence of new nozzle abnormality.

When the controller determines that the job is to be finished at any one of Step S12, Step S17, Step S20 and Step S23, the job is finished and the flowchart in FIG. 2 is finished.

Each of the plural non-ejection correction step at Step S16 and the remaining non-ejection correction step at Step S19 corresponds to a mode of the "plural non-ejection step".

A combination of the plural non-ejection correction step at Step S16, the remaining non-ejection correction step at Step S19, and the single non-ejection correction step at Step S22 corresponds to a mode of the "correction step".

[Image Abnormality Detecting Method]

An example of an image abnormality detecting method which can be applied to the image testing step at Step S13 will be described. As an example of a method of detecting abnormality on an image printed by the inkjet printing apparatus or particularly a method of detecting a streak, there are a first detecting method and a second detecting method as below.

The first detecting method is a method of reading an image after print by the scanner and of comparing the obtained read-out image with a reference image. The reference image may be an input image, for example. The second method which is another method is a method of detecting abnormality by outputting an exclusive test chart such as a nozzle test pattern or the like. Here, an outline of the first detecting method will be described.

Figure 3:
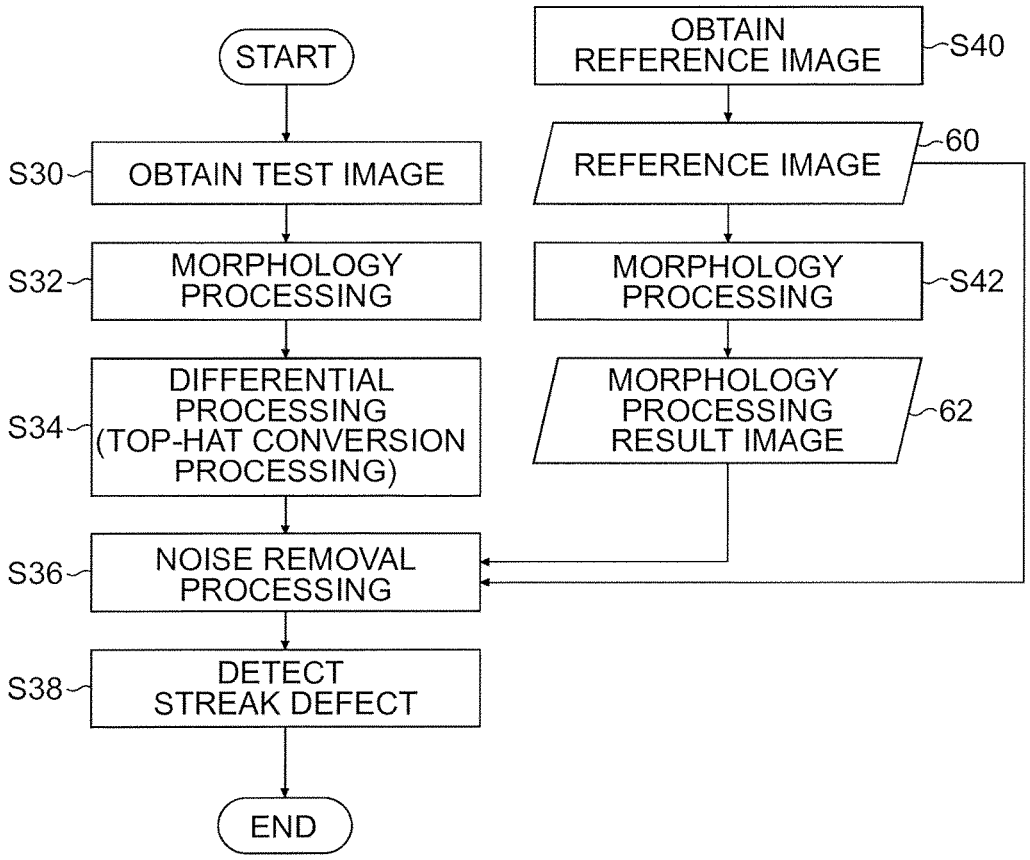
FIG. 3 is a flowchart illustrating an example of image abnormality detection processing.

FIG. 3 is a flowchart illustrating an example of image abnormality detection processing. Each step in FIG. 3 is executed by the image processing device of the controller. When the image abnormality detection processing illustrated in FIG. 3 is started, the image processing device carries out morphology processing (Step S32), differential processing (Step S34), and noise removal processing (Step S36) to a test image obtained by a test image obtaining step at Step S30 and detects a streak defect based on the image after the noise removal (Step S38).

The test image obtaining step at Step S30 is a step of taking in the test image to be tested. The test image is obtained by imaging a printed matter printed by the inkjet printing apparatus by an imaging device.

The imaging device is a device which converts an optical image to electronic image data by using an imaging device represented by a CCD (charge-coupled device) sensor or a CMOS (complementary metal-oxide semiconductor device) sensor. The imaging device may be a two-dimensional image sensor or may be a line sensor. Moreover, a color imaging device may be employed or a monochromic imaging device may be employed or they may be combined in configuration.

A scanner can be used as one form of the imaging device. Moreover, a camera can be used as one form of the imaging device. The term "imaging" includes a concept of "reading". The term imaging device is understood to have the same meaning as that of an image reading device which reads a printed matter. In this embodiment, the scanner is used as the imaging device. The scanner may be an in-line scanner installed in a medium conveyance path of the inkjet printing apparatus or may be an off-line scanner of a flat-bed type. In this embodiment, description is made by assuming that the test image is obtained by imaging a printed matter by using the in-line scanner.

In an obtaining mode of the test image, there can be a mode in which data of the test image obtained by the imaging device is obtained via a wired or wireless communication interface, a mode of obtaining the data of the test image stored in a memory card and other portable storage mediums from the portable storage medium via a media interface and the like in addition to a mode of directly obtaining from the imaging device.

The morphology processing at Step S32 and the differential processing at Step S34 are processing of extracting streak information from the test image.

Figure 4:
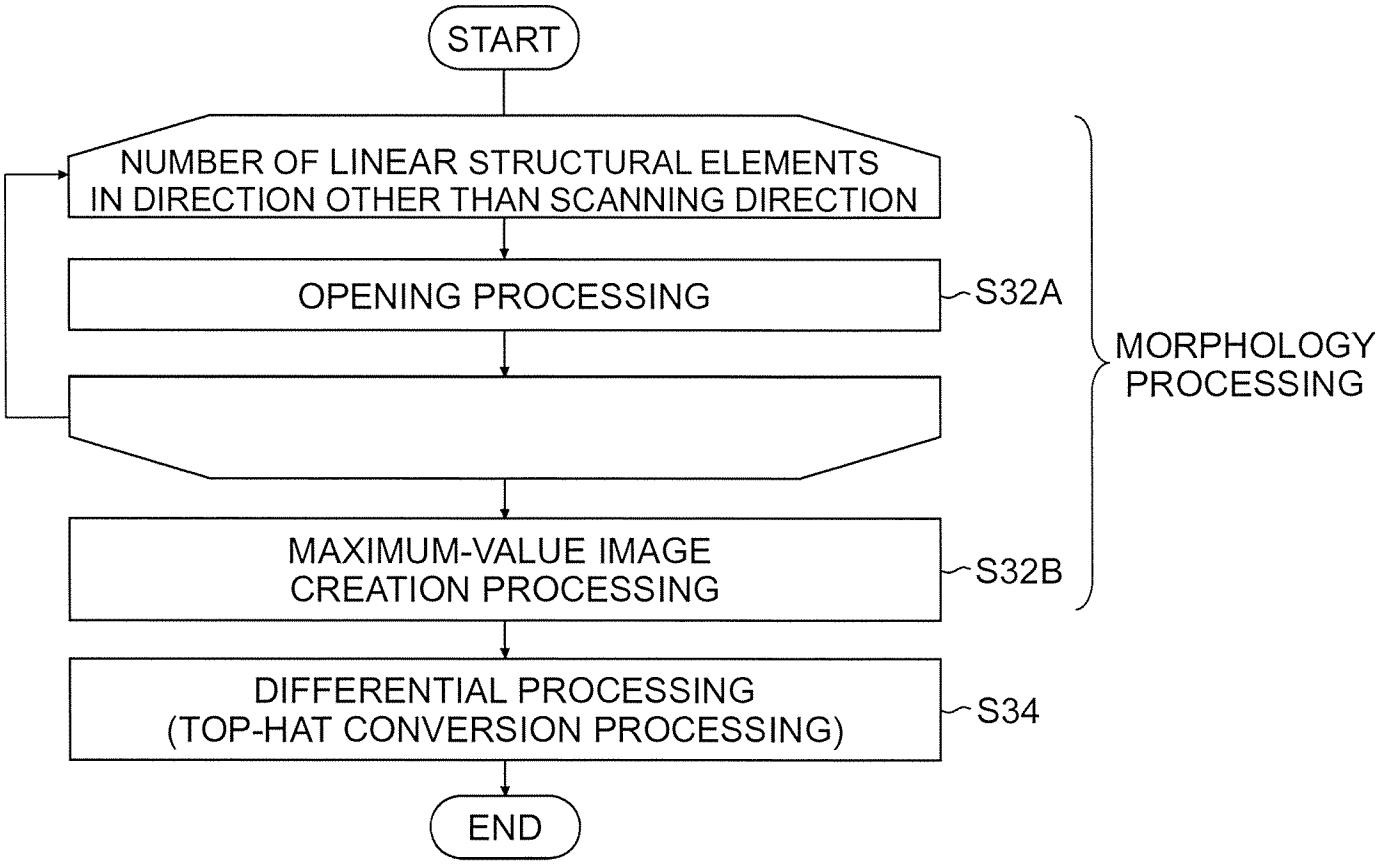
FIG. 4 is a flowchart illustrating contents of processing of extracting streak information from a test image.
Figure 5A:
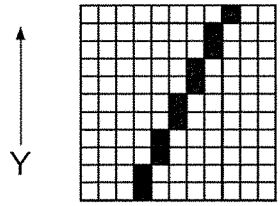
FIGS. 5A to 5G are diagrams illustrating examples of linear structural elements in a direction other than a scanning direction.
Figure 5B:
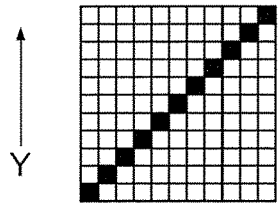
Figure 5C:
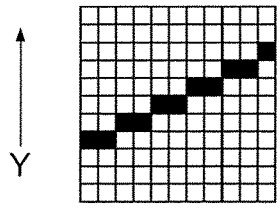
Figure 5D:
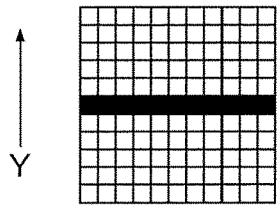
Figure 5E:
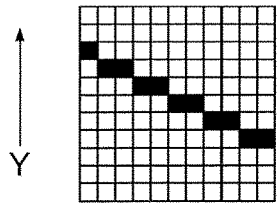
Figure 5F:
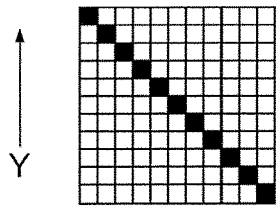
Figure 5G:
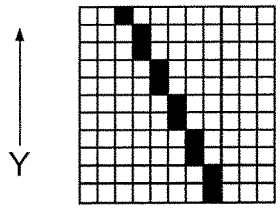

FIG. 4 is a flowchart illustrating contents of the processing of extracting streak information from the test image. The streak information extraction processing is processing of extracting information of a streak which is an image defect from the test image and can be also understood as image defect detection processing.

The streak information extraction processing includes opening processing (Step S32A) by linear structural elements in a direction other than a scanning direction, maximum-value image creation processing (Step S32B), and the differential processing (Step S34). From the opening processing (Step S32A) to the maximum-value image creation processing (Step S32B) are called the morphology processing in this embodiment.

The morphology processing illustrated at Step S32 in FIG. 3 includes Step S32A and Step S32B in FIG. 4.

When the processing in FIG. 4 is started, first, the opening processing (Step S32A) by the linear structural elements in the direction other than the scanning direction is carried out to the obtained test image. When the opening processing (Step S32A) is to be carried out, at least one linear structural element in the direction other than the scanning direction is determined in advance as a structural element of the image.

Figure 6:
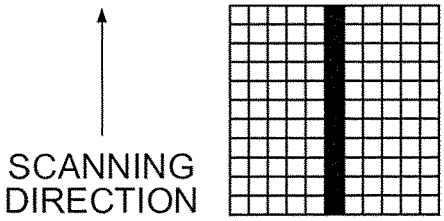
FIG. 6 is a diagram illustrating an example of the linear structural element in the scanning direction.

FIGS. 5A to 5G are diagrams illustrating examples of the linear structural elements in the direction other than the scanning direction. FIG. 6 is a diagram illustrating an example of the linear structural element in the scanning direction. FIG. 6 is illustrated as reference and is not used in the opening processing (Step S32A) in the embodiment.

The linear structural element refers to a space filter of a structural element corresponding to a linear structure of an image. The linear structural element only needs to indicate a substantially linear structure in a pixel range of a determined filter size. FIGS. 5A, 5C, 5E, and 5G are also grasped as linear structures within a range of resolution of the pixels. The direction other than the scanning direction means a direction not in parallel with the scanning direction. The linear structural element in the direction other than the scanning direction is called a "non-scanning direction linear structural element".

FIGS. 5A to 5G illustrate 7 kinds of the non-scanning direction linear structural elements. At least one non-scanning direction linear structural element is determined. That is, the number of the non-scanning direction linear structural elements can be an arbitrary number of 1 or more. In order to improve accuracy of the test, it is preferable that a plurality of the non-scanning direction linear structural elements is determined. Moreover, the filter size of the structural element is not limited to a size of 11×11 pixels exemplified in the drawing. The filter size of the structural elements can be an arbitrary size of 3×3 pixels or more.

By using at least one non-scanning direction linear structural element as illustrated in FIGS. 5A to 5G, the opening processing (Step S32A) of a grayscale image which is one of the morphology processing is carried out. The grayscale image refers to a multi-value continuous gradation image and corresponds to an 8-bit image expressed in 256 gradations, for example. It is needless to say that the gradation of the grayscale image is not limited to 8 bits but may be 14 bits or the like.

When the opening processing is carried out by using the linear structural element in a specific direction, smoothing of the image is carried out in a state where the linear structure in the specific direction is stored. The opening processing is processing combining dilation processing and erosion processing.

The opening processing by a structural element g of an image signal f is defined by the following equation 1. For simplification of description, it is expressed one-dimensionally.

[Equation 1]

$$f_g = \text{dilation}(\text{erosion}(f, g^s), g) \qquad \text{Equation 1}$$

$$\text{dilation}(f, g^s) = \max_{\substack{x+u\in F\\ u\in G}} \{f(x+u) + g(u)\}$$

$$\text{erosion}(f, g^s) = \max_{\substack{x+u\in F\\ u\in G}} \{f(x+u) - g(u)\}$$

F in the equation 1 is a domain of the signal f. G is a domain of the structural element g. $g^s$ indicates a symmetric set of g. $g^s$ is defined as that inverted horizontally and vertically of g.

For each of the at least one non-scanning direction linear structural element determined in advance, the opening processing is carried out. In the examples in FIGS. 5A to 5G, since 7 kinds of the non-scanning direction linear structural elements are defined, the opening processing is carried out by each or these 7 kinds of the non-scanning direction linear structural elements, and an image after the opening processing is obtained from each of the opening processing, and 7 kinds of the images after the opening processing in total are obtained.

Subsequently, at Step S32B in FIG. 4, the maximum-value image creation processing is carried out. In the maximum-value image creation processing (Step S32B), pixel groups after the opening processing are compared for each pixel, and a maximum-value image employing a maximum value at each of pixel positions is created. The maximum-value image creation processing (Step S32B) is expressed by an equation 2.

[Equation 2]

$$\overline{f}_g(x, y) = \max_{i=1,2,\wedge M} f_{g_i}(x, y) \qquad \text{Equation 2}$$

M in the equation 2 is an integer expressing a number of the structural elements. i is an index for discriminating the structural elements. In the maximum-value image created by the maximum-value image creation processing (Step S32B), the linear structures in the scanning direction are smoothed, while the other linear structures are not smoothed.

The maximum-value image created by the maximum-value image creation processing (Step S32B) corresponds to a first test image after smoothing. A step of the morphology processing combining the opening processing (Step S32A)

and the maximum-value image creation processing (Step S32B) corresponds to one form of a step of creating a first test image after smoothing.

After the maximum-value image creation processing at Step S32B, the routine proceeds to the differential processing (Step S34). In the differential processing (Step S34), a differential image obtained by subtracting the maximum-value image created at Step S14 from an original test image is created. Processing of obtaining the differential image by subtracting the maximum-value image from the original test image is called top-hat conversion. The differential processing (Step S34) can be considered to be the top-hat conversion processing.

The differential processing (Step S34), that is, the top-hat conversion processing is expressed by an equation 3.

[Equation 3]

$$\Delta f_g(x,y)=f(x,y)-f_g(x,y) \quad \text{Equation 3}$$

As the result of the differential processing (Step S34), the maximum-value image with only the linear structure in the scanning direction smoothed is subtracted from the original test image, and a linear component extending in the scanning direction such as a streak defect can be extracted.

The noise removal processing (Step S36) in FIG. 3 is processing of removing a scanning direction linear structure component included in the reference image from the differential image obtained by the differential processing (Step S34).

The noise removal processing (Step S36) is processing for suppressing misdetection that, if a linear structure component extending in the scanning direction is included in a figure of the printed image, the linear structure component of this figure is extracted as a "streak". Thus, the processing of removing the scanning direction linear structure component included in the reference image from the streak information by using the reference image is added.

Specifically, the series of morphology processing similar to the processing described in FIG. 4 is applied also to the reference image, and an extracted component is removed as a noise from the result of the differential processing (Step S34 in FIG. 3).

Assuming that the reference image is r(x, y) and a maximum-value image obtained by applying the morphology processing to the reference image is $r_g(x, y)$ in notation with an overline on the character of r, the fourth term on the right side in an equation 4 is the maximum-value image, and an image s(x, y) after noise removal can be obtained by calculation by the following equation 4, for example.

[Equation 4]

$$s_g(x,y)=(f(x,y)-\bar{f}_g(x,y))-(r(x,y)-\bar{r}_g(x,y)) \quad \text{Equation 4}$$

The maximum-value image obtained by applying the morphology processing to the reference image corresponds to one form of the first reference image after smoothing. The step of creating the first reference image after smoothing from the reference image can be understood as a step of creating the first reference image after smoothing.

The noise removal processing (Step S36) corresponds to the processing described in the equation 4. When the noise removal processing (Step S36) is carried out, a reference image 60 is prepared in advance, and a morphology processing result image 62 is created by applying the morphology processing (Step S42) to the reference image 60.

In the flowchart in FIG. 3, a flow of obtaining the morphology processing result image 62 which is image data of a processing result by applying the morphology processing (Step S42) to the reference image 60 obtained at the reference image obtaining step at Step S40 is illustrated.

The reference image 60 can be created based on the image data for print to be input in the inkjet printing apparatus, for example. As the reference image 60, the input image data itself may be used or those to which some image processing is applied to the input image data in order to facilitate comparison with the test image may be used. The "some image processing" can be any one of various types of basic image processing such as resolution conversion, gamma conversion, color conversion, geometric conversion, and space filtering or processing of combination. The input image data may be that before the halftone processing or that after the halftone processing. Moreover, as the reference image 60, a reference read-out image obtained by reading a non-defective printed image in which a streak defect did not occur in an actual printed matter can be used. The processing of creating the reference image based on the input image data or the processing of creating a reference read-out image by reading a printed matter without a streak defect can be grasped as reference image creation processing.

The reference image obtaining step (Step S40) may be understood as obtainment of the reference image by creating a reference image by the reference image creation processing or may be understood of obtainment of data of the reference image created by the reference image creation processing through a wired or wireless signal transmitting device or a portable storage medium.

The morphology processing (Step S42) is similar to the contents at Step S32A and Step S32B in FIG. 4. The morphology processing result image 62 corresponds to the first reference image after smoothing.

In the noise removal processing (Step S36 in FIG. 3), noise removal is carried out from the differential image as described in the equation 4 by using the reference image 60 and the morphology processing result image 62.

In the streak defect detection step at Step S38, detection of a streak defect is carried out from the differential image after the noise removal obtained by the noise removal processing (Step S36). As a method of detecting a streak defect by using the differential image after the noise removal obtained by Step S36, various methods can be considered. Here, the following method is introduced as an example. That is, with respect to the differential image after the noise removal, a plurality of sections to be used as target regions for calculation processing is set, a pixel value of an image is integrated in the scanning direction which is a vertical direction in each of the sections or made into an average value, and a one-dimensional profile is obtained. When a signal value on the one-dimensional profile exceeds a threshold value determined in advance, it is determined that there is a streak defect.

At the streak defect detection step (Step S38), the streak defect detection processing of determining presence of a streak defect is carried out by creating a one-dimensional profile from the differential image as described above or the like.

In FIG. 3, the reference image 60 and the morphology processing result image 62 of the reference image 60 are provided to the noise removal processing (Step S36), but as indicated by the equation 4, a differential image obtained by subtracting the morphology processing result image 62 from the original reference image 60 may be provided. In this case, after the morphology processing (Step S42), the differential processing (top-hat conversion processing) is carried out similarly to Step S34 in FIG. 3, and a reference differential image which is a differential image is created in advance. By preparing this reference differential image in advance, a form which is utilized in the noise removal processing can be realized (Step S36).

[Non-Ejection Correcting Method]

Here, a non-ejection correcting method which is an example of the image correcting method which can be applied to the correction step illustrated in Step S16, Step S19 or Step S22 in FIG. 2 will be described.

In this embodiment, as the image correcting method for suppressing visibility of a streak caused by abnormality of a nozzle, such a method is used that the abnormality of the nozzle is detected, a nozzle corresponding to the abnormal spot is made non-ejectable, and a portion of the nozzle which was made non-ejectable is filled by ejection from a nozzle in the vicinity. As a method of correcting a streak caused by the abnormal nozzle, the method disclosed in Japanese Patent No. 5597680 can be used, for example. In the method disclosed in Japanese Patent No. 5597680, by outputting a chart simulating a case where each nozzle is non-ejectable and by determining strength of a peripheral nozzle of the non-ejection nozzle so as to flatten this chart, a correction parameter when non-ejection occurs is determined.

Figure 7:
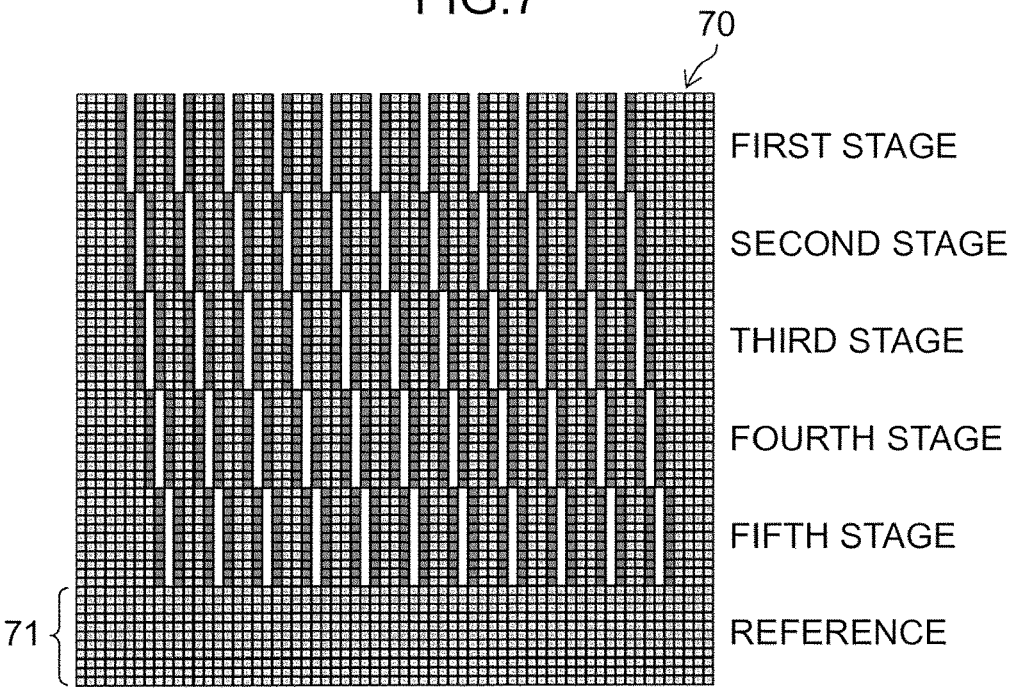
FIG. 7 is a schematic diagram illustrating an example of a chart for calculating a single non-ejection correction parameter.

FIG. 7 is a schematic diagram of a chart 70 for calculating a single non-ejection correction parameter used in this embodiment. Actually, such a white streak in this figure cannot be visually recognized, but it is expressed to be understood easily for description. Moreover, in FIG. 7, a cell of a pixel is drawn, but a mark line of a cell does not exist in an actual chart. The same applies to FIG. 8.

The chart 70 for calculating a single non-ejection correction parameter illustrated in FIG. 7 has N stages of patterns arranged, each having a simulated non-ejection region in which non-ejection is simulated at an interval of N lines with respect to a solid image region in gradation to be optimized. N is a natural number and an example of N=5 is illustrated in FIG. 7. The "solid image region" means a "region with certain density". Moreover, a non-ejection correction region which is a region adjacent to each of the simulated non-ejection regions has density obtained by applying the non-ejection correction parameter to density of the region with certain density.

In order to form this chart 70 for calculating a single non-ejection correction parameter, data of one of the stages in the chart is data that first nozzles at every N nozzles in a direction orthogonal to a conveyance direction of the sheet do not eject ink and form a simulated non-ejection region, second nozzles adjacent to both sides of the first nozzles form a non-ejection correction region by an instructed value corrected by the non-ejection correction parameter, and third nozzles other than the first nozzles and the second nozzles form the region with certain density by an instructed value not corrected.

The direction orthogonal to the conveyance direction of the sheet is called a nozzle alignment direction in some cases. The nozzle alignment direction corresponds to the X-direction. The first nozzle corresponds to the "simulated non-ejection nozzle". The second nozzle corresponds to the "non-ejection correction nozzle".

That is, the chart for calculating a single non-ejection correction parameter has the simulated non-ejection region formed by the first nozzle, the non-ejection correction region formed by the second nozzles which are nozzles adjacent to the both sides of the first nozzle, and the region with certain density formed by the third nozzle other than the first nozzle and the second nozzle, one stage in which the simulated non-ejection regions are disposed in a first direction at a predetermined interval is disposed in plural in a second direction orthogonal to the first direction, and the simulated non-ejection regions in the plurality of stages are disposed at different positions with respect to the first direction, respectively. Moreover, the data of the chart for calculating a single non-ejection correction parameter is data which does not allow the first nozzle to eject ink, allows the third nozzle to eject the ink with the instructed value of predetermined density, and allows the second nozzle to eject the ink with the instructed value obtained by correcting the instructed value of the predetermined density by the non-ejection correction parameter of the adjacent first nozzle.

Specifically, assuming that the instructed value of the gradation to be optimized is D and the nozzle number of the first nozzle is i, the data is such that the first nozzle is not allowed to eject the ink, the second nozzles with the nozzle numbers i−1 and i+1 are allowed to eject with the instructed value of D×mi, and the third nozzles with the nozzle numbers i−N+1, . . . , i−3, i−2, i+2, i+3, . . . , i+N−1 are allowed to eject with the instructed value of D. The nozzle numbers are integer numbers uniquely given to each of the nozzles in accordance with an alignment order of the nozzles in the X-direction in the inkjet head. Reference character mi is a non-ejection correction parameter indicating correction intensity of each nozzle.

Moreover, in each stage of the chart for calculating a single non-ejection correction parameter, the first nozzles are disposed by being shifted in the nozzle alignment direction. In the example of FIG. 7, the nozzle numbers of the first nozzles are disposed such as i, i+1, i+2, i+3, i+4 one by one in each stage. By disposing the first nozzles in each stage while shifting them in the nozzle alignment direction as above, all the nozzles can be made the simulated non-ejection nozzles. As a result, the non-ejection correction parameters of all the nozzles can be evaluated.

In the chart 70 for calculating a single non-ejection correction parameter, a reference density stage 71 as illustrated in FIG. 7 may be provided. In the reference density stage 71, the region with certain density in the gradation to be optimized is drawn by all the nozzles. When the reference density stage 71 is provided, a difference between a scan density in the vicinity of the simulated non-ejection region and the scan density of the reference density stage can be used as a correction intensity evaluation value. As a result, shading of the scanner or unevenness of resolution in the nozzle direction can be offset, and influences of a low-frequency streak unevenness specific to the single path method can be reduced. The scan density can be average density calculated based on the read-out image signal.

In the example in FIG. 7, the nozzles adjacent to the both sides of the simulated non-ejection nozzle are made the non-ejection correction nozzles, and the non-ejection correction parameter of the simulated non-ejection nozzle is applied to these non-ejection correction nozzles, but the non-ejection correction nozzle is not limited to this form. For example, in addition to the nozzle adjacent to the both sides of the simulated non-ejection nozzle, the nozzles further adjacent to the nozzles may be made the non-ejection correction nozzles. That is, when the nozzle with the nozzle number i is made the simulated non-ejection nozzle, a mode in which the nozzles with the nozzle numbers i−2, i−1, i+1, and i+2 are made the non-ejection correction nozzles can be also used.

In this embodiment, the single non-ejection correction parameter of each of the nozzles is acquired in advance by using the chart 70 for calculating a single non-ejection correction parameter as in FIG. 7, and when abnormality occurs in a nozzle, the target nozzle is made non-ejectable and is corrected by using the correction parameter described above, whereby a streak caused by nozzle abnormality can be made invisible.

The correction parameter in the single non-ejection correction mode can be created by the aforementioned method. The correction parameter in the plural non-ejection correction mode can also use the correction parameter in the single non-ejection correction mode.

Figure 8:
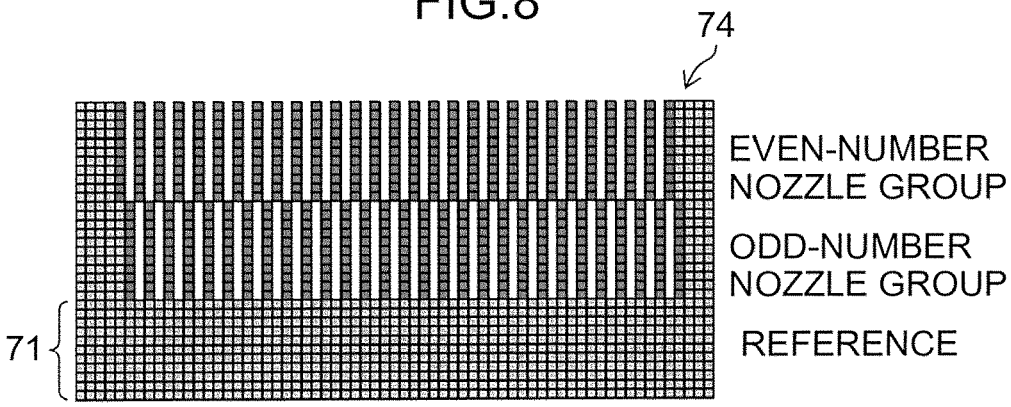
FIG. 8 is a schematic diagram illustrating an example of a chart for calculating a plural non-ejection correction parameter.

Alternatively, such configuration can be also used as illustrated in FIG. 8 that a chart 74 for calculating a plural non-ejection correction parameter for the plural non-ejection correction mode is output and the correction parameter exclusive for the plural non-ejection correction mode is acquired. In the chart 74 for calculating a plural non-ejection correction parameter exemplified in FIG. 8, a pattern having a simulated non-ejection region in which the even-number nozzle group is set to a simulated non-ejection nozzle and a pattern having a simulated non-ejection region in which the odd-number nozzle group is set to the simulated non-ejection nozzle are disposed in two stages with respect a solid image region in the gradation to be optimized. Moreover, the chart 74 for calculating a plural non-ejection correction parameter has a reference density stage 71. The even-number nozzle group refers to a nozzle group with even-number nozzle numbers. The odd-number nozzle group refers to a nozzle group with odd-number nozzle numbers.

By using the chart as illustrated in FIG. 8, a correction parameter with higher accuracy can be acquired in the plural non-ejection correction mode.

[Mask Processing and Halftone Processing in Correction Processing of Plural Non-Ejection Correction]

If the nozzle group is made non-ejectable, non-ejection closely gathers and stains the image and correction cannot be exerted properly in some cases. In order to solve such problems, the method disclosed in Japanese Patent Application Laid-Open No. 2014-144610 or the method disclosed in Japanese Patent No. 5791155 or a combination thereof can be carried out.

An aspect of the image processing method disclosed in Japanese Patent Application Laid-Open No. 2014-144610 is an image processing method which includes a defect information obtaining process of obtaining information of a defective recording element in a recording head in which a plurality of recording elements is aligned, a mask processing process of carrying out mask processing of disabling the defective recording element based on the defective recording element information obtained in the defect information obtaining process, an image correcting process of correcting image density of a pixel row adjacent to the pixel row corresponding to the defective recording element subjected to the mask processing in input image data in order to lower visibility of a streak-like image defect involved in the mask processing, and the quantization processing process of quantizing the image data after the correction of image density in the image correcting process and converting to binary or multi-value image data having less gradation than the image data after the correction of image density, the quantization processing process having a first quantization process of quantization by applying a first quantization method for a first image region including the pixel row corresponding to the defective recording element subjected to the mask processing and a pixel row adjacent thereto and a second quantization process of quantization by applying a second quantization method different from the first quantization method for a second image region other than the first image region, in which, in at least a part of the gradations, a first quantization pattern obtained by the quantization which applies the first quantization method has a first pattern characteristic in which a low-frequency component in a spatial frequency component in a first direction in parallel with a relative movement direction of the recording medium with respect to the recording head is more suppressed than all the spatial frequency components in a second direction orthogonal to the first direction as compared with a second quantization pattern obtained by the quantization which applies the second quantization method.

The "recording element in Japanese Patent Application Laid-Open No. 2014-144610 corresponds to the nozzle in this embodiment and the "mask processing" corresponds to the non-ejection. The "process" has the same meaning as the "step".

One aspect of the image processing method disclosed in Japanese Patent No. 5791155 is an image processing method including a threshold-value matrix storing process of storing a threshold value matrix used in quantization processing of converting the input image data to image data having fewer gradations than the gradations of the input image data, an abnormal recording element information obtaining process of obtaining abnormal recording element information, a mask processing process of applying mask processing to the abnormal recording element based on the obtained abnormal recording element information, a threshold-value matrix modification process of modifying correspondence between the recording element and the threshold value so that processing of a pixel to be formed by the abnormal recording element subjected to the mask processing is excluded and continuity of a pattern of the threshold-value matrix is maintained, and a quantization processing process of carrying out quantization processing by using threshold-value matrix.

When the user image is to be printed by applying the plural non-ejection correction mode, the method disclosed in Japanese Patent Application Laid-Open No. 2014-144610, the method disclosed in Japanese Patent No. 5791155 or image processing by a combination of them is preferably applied.

[Nozzle Specification Availability Determination Processing]

Subsequently, an example of a determination method which can be applied to the nozzle specification availability determination processing illustrated at Step S15 in FIG. 2 will be described.

Figure 9:
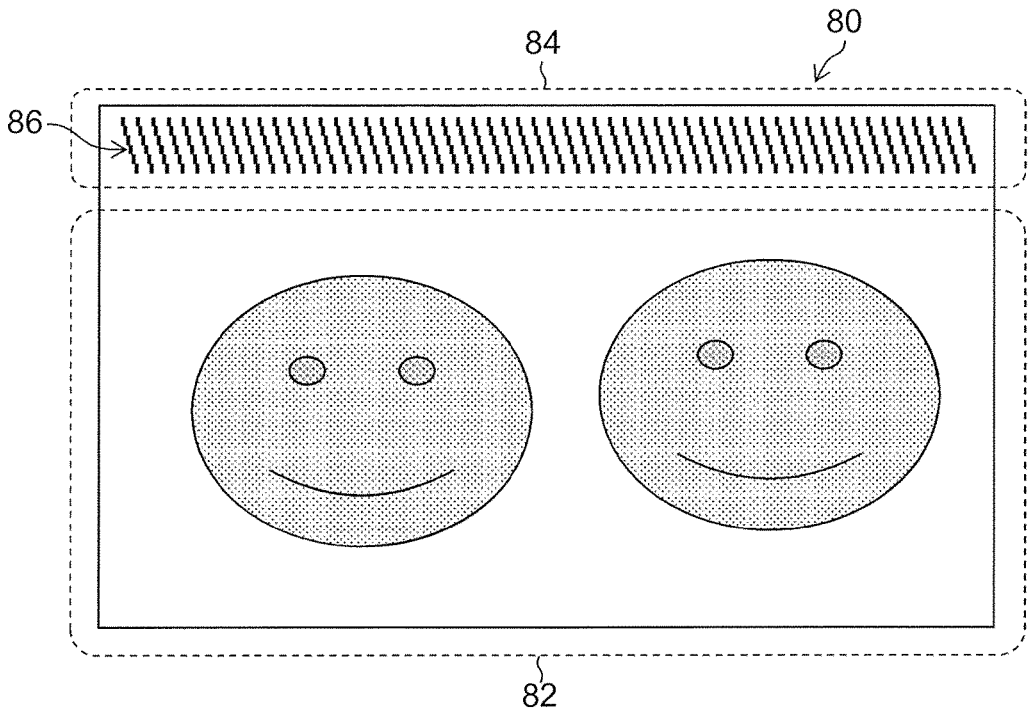
FIG. 9 is a diagram illustrating an example of a printed matter printed by the ink-jet printing apparatus of this embodiment.

FIG. 9 is an example of a printed matter 80 printed in the inkjet printing apparatus of this embodiment. As an example suitable for this embodiment, the printed matter 80 has a user image region 82 and a nozzle test region 84 as illustrated in FIG. 9. The user image region 82 is a region in which the user image is printed. The nozzle test region 84 is a region other than the user image region. The nozzle test region 84 is a region where a nozzle test pattern 86 for testing an ejection state of the nozzle is printed. The nozzle test pattern 86, for example, is a chart of a line pattern recording a line extending in the Y-direction by the individual nozzles for examining the ejection state of each nozzle and is also called a line chart for nozzle test. As the nozzle test pattern 86, a ladder pattern by l-on n-off ejection control can be used, for example. Based on a recording result of the nozzle test pattern 86, the abnormal nozzle can be specified. The line chart for nozzle test which can test the ejection state of each nozzle corresponds to one form of the "second test chart".

Figure 10:
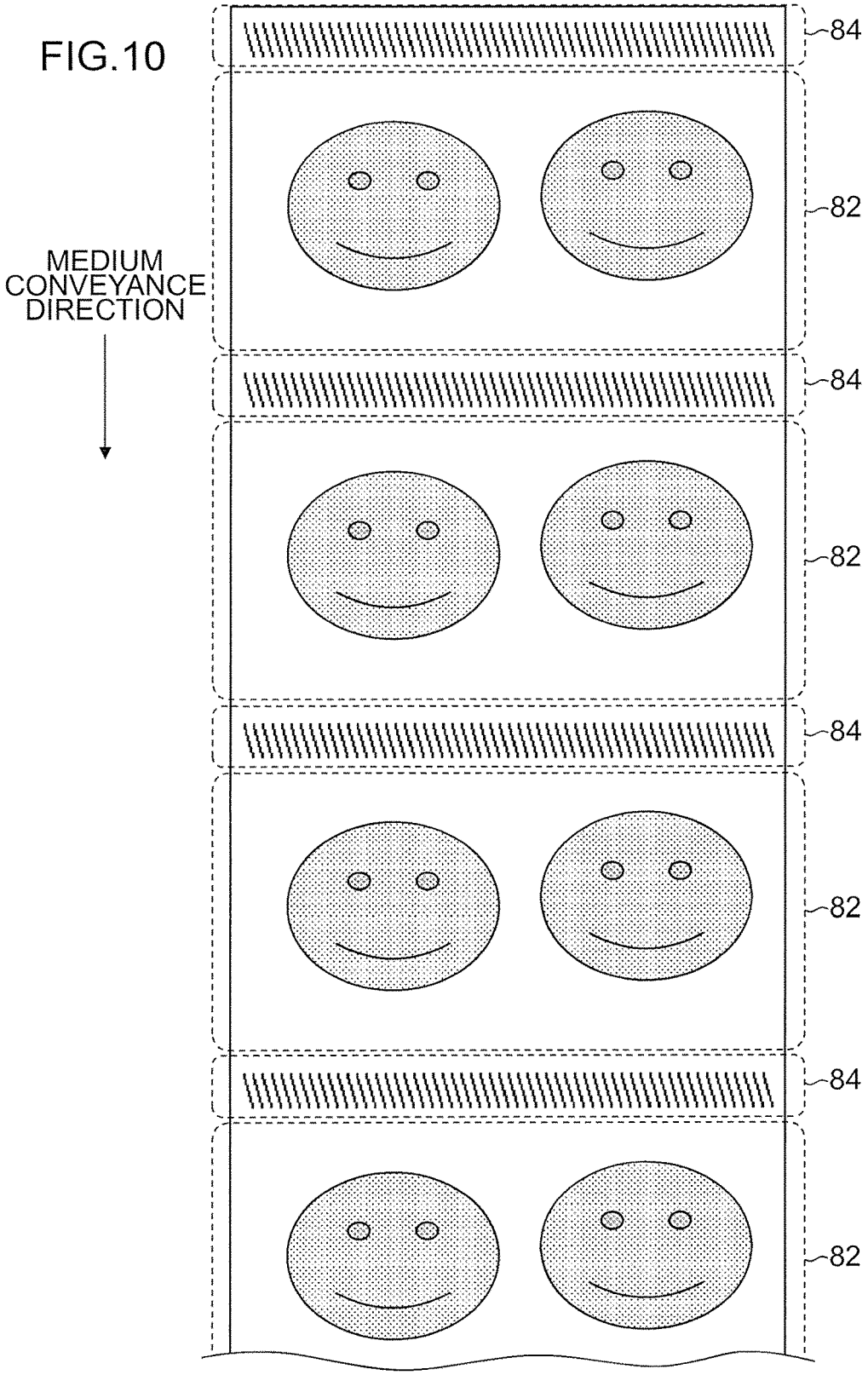
FIG. 10 is a diagram illustrating an example of a printed matter when a continuous sheet is used.

FIG. 9 illustrates an example using a sheet of paper as a recording medium, but continuous paper may be used as the recording medium. FIG. 10 is an example using the continuous paper. In the case of the continuous paper, too, constitution having the user image region 82 and the nozzle test region 84 can be used similarly to FIG. 9.

The inkjet printing apparatus according to this embodiment includes an in-line scanner as a device for reading an image after print. The in-line scanner reads an image in each of the nozzle test region 84 and the user image region 82. In each of the regions, different testing methods are employed, and tests are conducted under different testing items.

The test image read out of the nozzle test region 84 is the line chart for nozzle test, and the method disclosed in Japanese Patent No. 5725597 can be used, for example, as the specific testing method. The testing items in the test of the nozzle test region 84 are presence of nozzle abnormality and a nozzle number of the abnormal nozzle. In the test of the nozzle test region 84, since an exclusive chart specific to the nozzle test can be used, the abnormal nozzle can be specified. On the other hand, the nozzle abnormality found in the test of the nozzle test region 84 does not necessarily correspond to the abnormality of the user image.

The test image read out of the user image region 82 is a printed image printing the user image. As a specific testing method, the method described in FIGS. 3 and 4 can be used. The testing items in the test of the user image region 82 are presence of abnormality in an image and an abnormal region. One session of test of the user image region 82 cannot specify the nozzle number of the abnormal nozzle but only an abnormal region corresponding to a range of the nozzle numbers including the abnormal nozzle is grasped. In the test of the user image region 82, since the user image is used, the abnormal nozzle cannot be specified only in one session of the test. On the other hand, presence of abnormality of the user image can be reliably specified.

In the two types of tests, that is, the test of the nozzle test region 84 and the test of the user image region 82, whether or not the abnormal nozzle can be specified is different depending on the respective testing methods. In the chart of the nozzle test region 84, since the chart specific to the nozzle test can be used, the nozzle in which abnormality occurred can be specified, while the test of the user image region 82 cannot do the same, which should attract attention.

Occurrence of abnormality of the nozzle is not necessarily stable but can change momentarily. For example, if nozzle abnormality occurs in both of the nozzle test region 84 and the user image region 82, the abnormal nozzle can be specified by the test of the nozzle test region 84.

Figure 11:
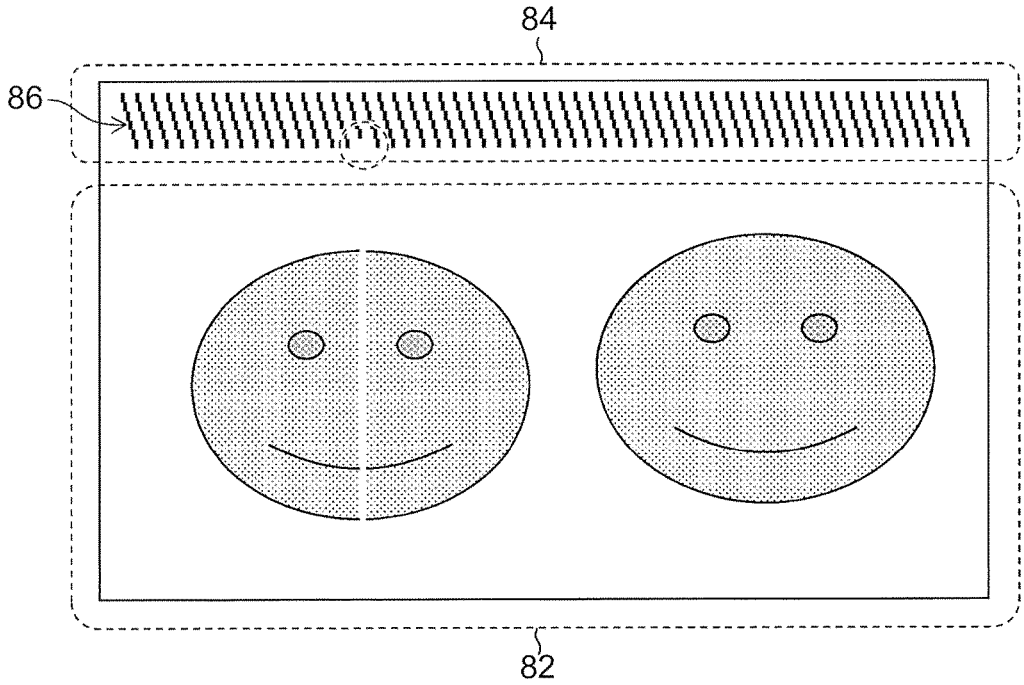
FIG. 11 is an example of a printed matter when nozzle abnormality occurred in both of a nozzle test region and a user image region.

FIG. 11 is an example of a printed matter when nozzle abnormality occurred in both of the nozzle test region 84 and the user image region 82. In the example in FIG. 11, nozzle abnormality is detected at a spot indicated by a broken-line circle of a chart printed on the nozzle test region 84. Moreover, abnormality of a streak caused by nozzle abnormality is detected from the user image in the user image region 82. In the case exemplified in FIG. 11, since the abnormality occurred in the nozzle test region 84 where the nozzle in which the abnormality occurred can be specified, the abnormal nozzle can be specified.

When the abnormal nozzle could be specified, the Yes determination is obtained at Step S15 in FIG. 2 having been already described, and the single non-ejection correction by Step S22 can be performed. That is, the specified abnormal nozzle is made non-ejectable, and the correction in the single non-ejection correction mode is performed so that the streak can be made invisible.

On the other hand, when abnormality occurs only in the user image region 82 and no abnormality occurs in the nozzle test region 84, occurrence of nozzle abnormality can be determined, but which nozzle is the abnormal nozzle cannot be specified and thus, correction in the single non-ejection correction mode cannot be made immediately.

Figure 12:
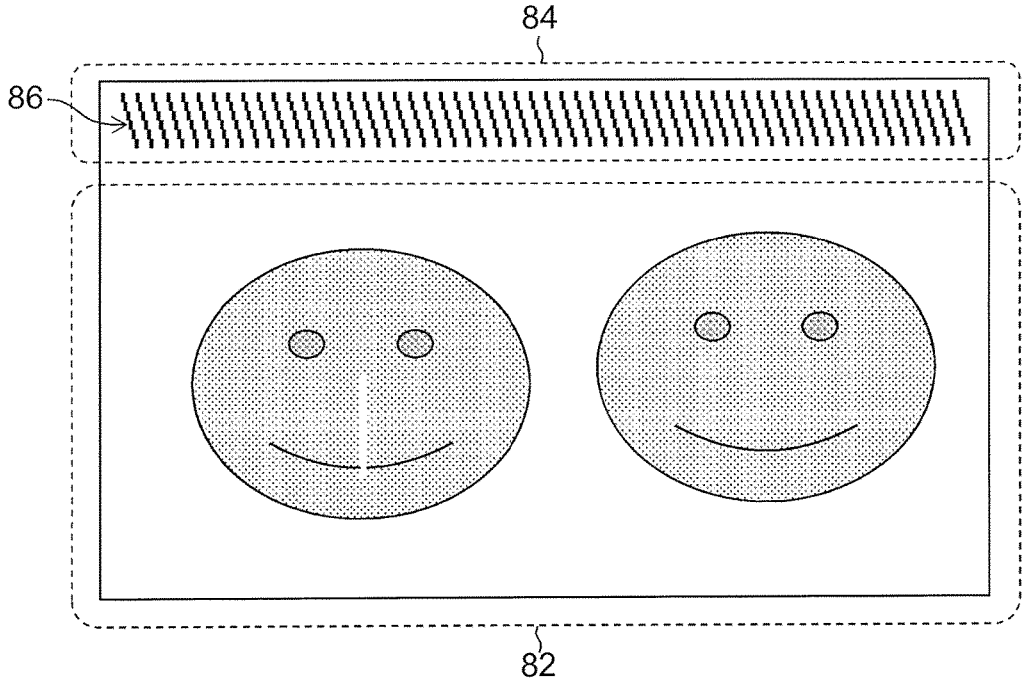
FIG. 12 is an example of a printed matter when nozzle abnormality did not occur in the nozzle test region and nozzle abnormality occurred only in the user image region.

FIG. 12 is an example of a printed matter when the nozzle abnormality does not occur in the nozzle test region 84 and the nozzle abnormality occurs only in the user image region 82. In the example in FIG. 12, abnormality is not detected from the nozzle test region 84 but abnormality is detected only in the user image region 82. In the case exemplified in FIG. 12, since the abnormality occurs only in the user image region 82, the abnormal nozzle cannot be specified.

As described above, since whether the abnormal nozzle can be specified or not changes depending on the region to be tested and the testing method, whether the abnormal nozzle can be specified or not can be determined by using information of test results of the two types of tests.

As another constitution example, the testing method of the nozzle test region may be so constituted capable of being switched between a first nozzle testing method capable of specifying an abnormal nozzle and a second nozzle testing method incapable of specifying the abnormal nozzle. For the first nozzle testing method, the method described in Japanese Patent No. 5725597 can be employed. For the second nozzle testing method, the method of detecting a difference in the jobs in the line chart for nozzle test can be employed. The testing item by the second nozzle testing method is presence of fluctuation in each nozzle group to attract attention. For example, the line chart for nozzle test is printed each time the user image is printed, the line chart for nozzle test is read, and presence of fluctuation in each nozzle group is detected from the difference in the read-out images of the chart. With the second nozzle testing method, specification of the abnormal nozzle is difficult, but many nozzles can be tested at once.

When the first nozzle testing method and the second nozzle testing method are both used while being switched, if abnormality is detected by the first nozzle testing method capable of specifying the abnormal nozzle, the abnormal nozzle can be specified, while if the abnormality is detected by the second nozzle testing method incapable of specifying the abnormal nozzle, the abnormal nozzle cannot be specified. In the case where the abnormal nozzle can be specified, the routine proceeds from Step S15 to Step S22 in FIG. 2, and the single non-ejection correction is performed by making the specified abnormal nozzle non-ejectable.

On the other hand, in the case where the abnormal nozzle cannot be specified, the routine proceeds from Step S15 to Step S16 in FIG. 2, and the plural non-ejection correction is performed to the nozzle group and the nozzle group including the abnormal nozzle is specified.

[Abnormality Detection of Image and Abnormal Region Setting Method]

Figure 13:
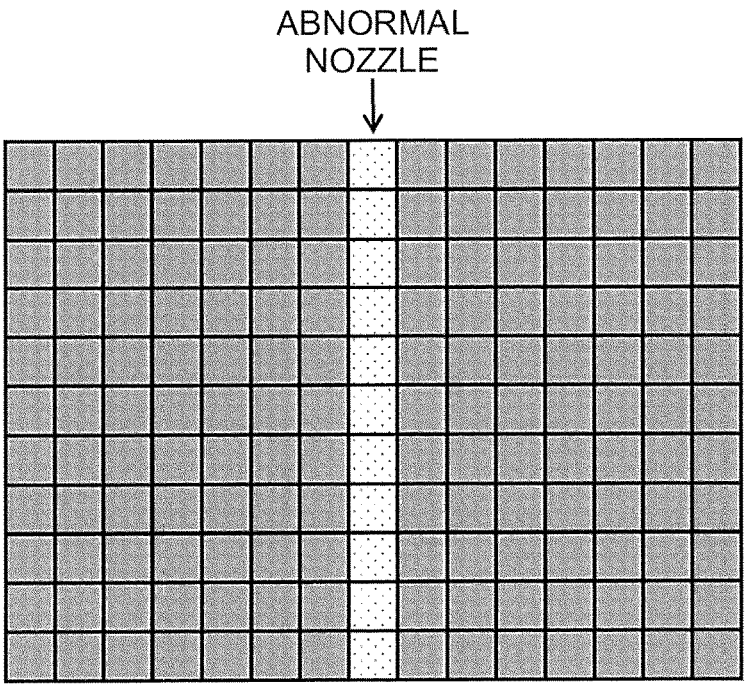
FIG. 13 is a diagram schematically illustrating a printed image when abnormality is found in a printed image.

FIG. 13 is a diagram schematically expressing a printed image if abnormality is found in the printed image. Each cell indicates a pixel of the printed image. The lateral direction in FIG. 13 is the X-direction, and the vertical direction is the Y-direction. With each of pixels aligned in the X-direction, a nozzle in charge of recording of each pixel is associated. Therefore, a position of the pixel in the X-direction can be understood as a position of the nozzle.

A nozzle in charge of recording at a pixel position on an eighth column from the left in FIG. 13 is an abnormal nozzle. By means of the abnormal nozzle, a streak extending in the Y-direction appears at the corresponding image position. A pixel column of the image portion which becomes the streak is indicated by light shading in FIG. 13.

Figure 14:
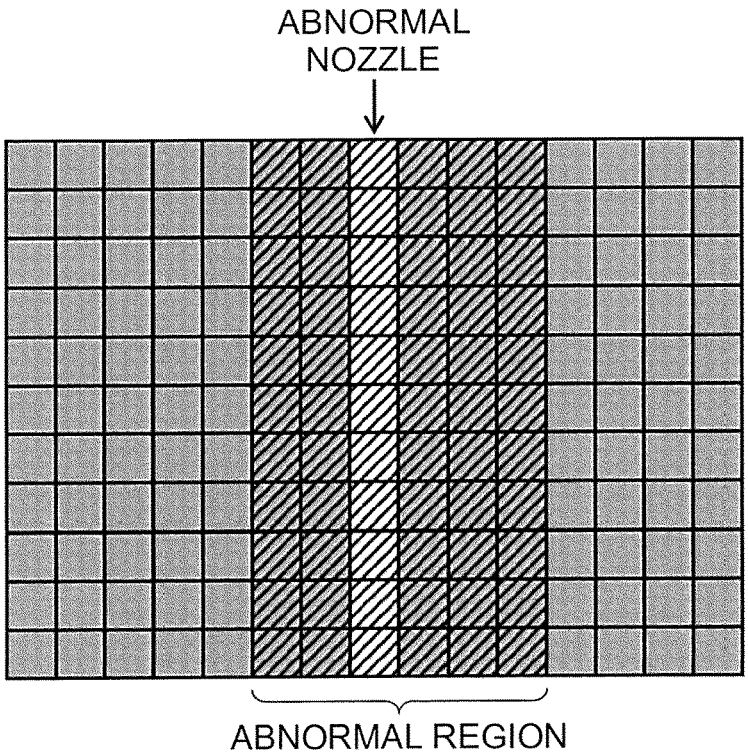
FIG. 14 is a schematic diagram illustrating a state where an abnormal region including a position of the abnormal nozzle is set.

FIG. 14 is a schematic diagram illustrating a state where an abnormal region including the position of the abnormal nozzle is set. FIG. 14 illustrates the fact that an image region corresponding to a nozzle range of 6 nozzles suspected to be abnormal nozzles on the image is set as an abnormal region. In the example in FIG. 14, the region for the 6 pixels continuing in the X-direction is set as the abnormal region, but a pixel range set as the abnormal region can be an appropriate range with 1 pixel or more in accordance with resolution of the scanner.

Processing of setting the abnormal region is carried out when the plural non-ejection correction at Step S16 in the flowchart described in FIG. 2 is performed.

[Specifying Method of Nozzle Group Including Abnormal Nozzle]

Figure 15:
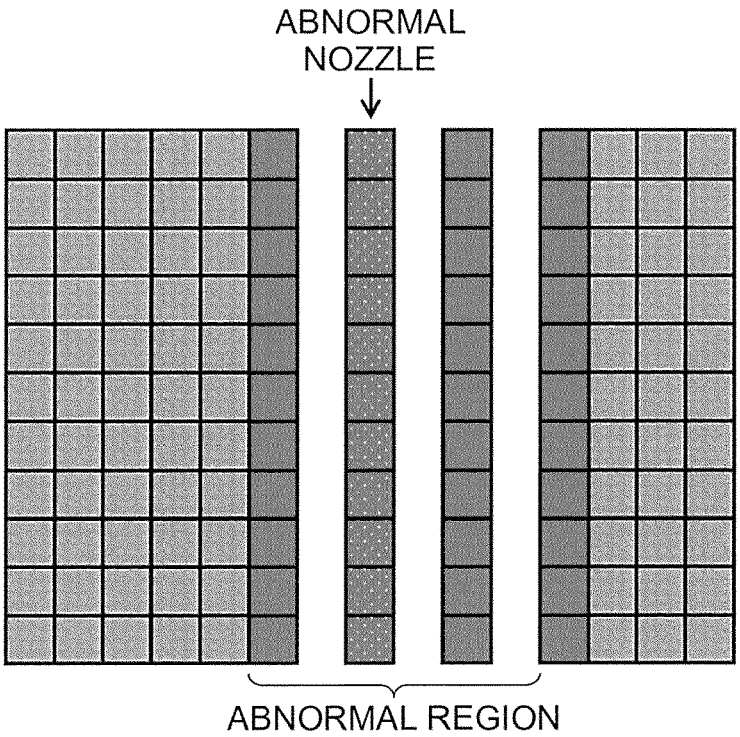
FIG. 15 is a schematic diagram illustrating a state where the plural non-ejection correction was made by making a first nozzle group belonging to a nozzle range corresponding to an abnormal region non-ejectable.

Subsequently, a specific example of a nozzle-group searching method for specifying a nozzle group including an abnormal nozzle will be described. FIG. 15 is a schematic diagram illustrating a state where the plural non-ejection correction is performed by making the first nozzle group belonging to the nozzle range corresponding to the abnormal region non-ejectable. A first nozzle group made non-ejectable in FIG. 15 is an odd-number nozzle group, for example. For facilitation of description, it is assumed that a column number of a pixel matches a nozzle number such that a nozzle number of a nozzle in charge of recording of a pixel row on a first column from the left end of FIG. 15 is "1" and a second column has a nozzle number 2. The abnormal region corresponds to a range from the nozzle numbers 6 to 11. The odd-number nozzle group in the abnormal region includes nozzles with the nozzle numbers 7, 9, and 11.

The example in FIG. 15 illustrates a state where the odd-number nozzle group with the nozzle numbers 7, 9, and 11 is made non-ejectable, and the non-ejection correction is performed to the nozzles made non-ejectable by using an adjacent nozzle. In this case, a nozzle with the nozzle number 8 which is the abnormal nozzle is used for the non-ejection correction. However, since the nozzle with the nozzle number 8 used for the correction is the abnormal nozzle, a proper correction effect cannot be obtained, but a streak is visible in the image. That is, the non-ejection correction in the plural non-ejection correction mode to the odd-number nozzle group fails.

Figure 16:
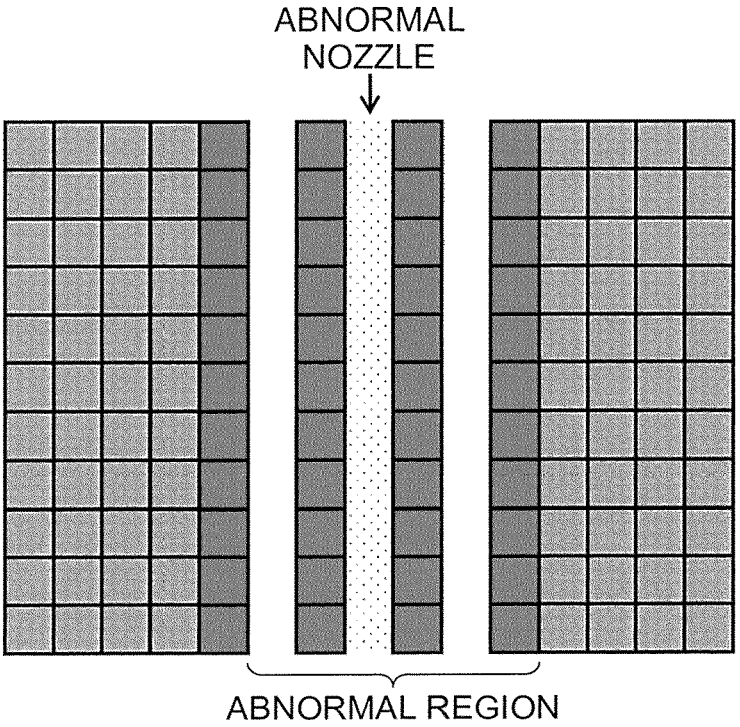
FIG. 16 is a schematic diagram illustrating a state where the plural non-ejection correction was made by making a second nozzle group belonging to the nozzle range corresponding to the abnormal region non-ejectable.

FIG. 16 is a schematic diagram illustrating a state where the plural non-ejection correction is performed by making a second nozzle group belonging to the nozzle range corresponding to the abnormal region non-ejectable. The second nozzle group made non-ejectable in FIG. 16 is an even-number nozzle group, for example. The even-number nozzle group in the abnormal region includes nozzles with nozzle numbers 6, 8, and 10.

The example in FIG. 16 illustrates a state where the even-number nozzle group with the nozzle numbers 6, 8, and 10 is made non-ejectable, and the non-ejection correction is performed to the nozzles made non-ejectable by using an adjacent nozzle. In this case, a nozzle with the nozzle number 8 which is the abnormal nozzle is made non-ejectable, and the non-ejection correction is performed by the other normal nozzles and thus, by means of the effect of non-ejection correction, a favorable image in which a streak is made invisible is obtained. That is, the non-ejection correction in the plural non-ejection correction mode to the even-number nozzle group succeeds. As a result, it is grasped that the abnormal nozzle belongs to the even-number nozzle group.

As described in FIGS. 15 and 16, to which nozzle group the abnormal nozzle belongs can be determined by making the non-ejection correction by switching the nozzle groups. When the abnormal nozzle is included in the nozzle group made non-ejectable, it is corrected appropriately, while if not included, a streak is made. Whether appropriate correction is performed or not can be determined by reading the image of the user image region 82 and by conducting a test for analyzing the read-out image.

A correction mode for correction by making the odd-number nozzle group non-ejectable is called the odd-number nozzle group correction mode. A correction mode for correction by making the even-number nozzle group non-ejectable is called the even-number nozzle group correction mode. The plural non-ejection correcting device in this embodiment can selectively make a correcting operation in the even-number nozzle group non-ejection correction mode and the correcting operation in the odd-number nozzle group non-ejection correction mode.

Assuming that the abnormal nozzle is not recovered, since the abnormal nozzle certainly belongs to either one of the even-number nozzle group and the odd-number nozzle group, by making correction in either one of the even-number nozzle group correction mode and the odd-number nozzle group correction mode, the nozzle group to which the abnormal nozzle belongs can be specified by presence of abnormality in the image after the correction. Therefore, if it is confirmed that the non-ejection correction failed in the odd-number nozzle group non-ejection correction mode as in FIG. 15, for example, it may be determined that the abnormal nozzle belongs to the even-number nozzle group.

Each of the odd-number nozzle group correction mode and the even-number nozzle group correction mode is configured to make every other nozzle non-ejectable in the X-direction. The nozzles are divided into two types of nozzle groups, that is, the odd-number nozzle group and the even-number nozzle group in FIGS. 15 and 16, but how to determine the nozzle group is not limited to this example, and three kinds or more of nozzle groups may be used such as a nozzle group of every two nozzles or a nozzle group of every three nozzles. The plural non-ejection correction by the plural non-ejection correcting device of this embodiment performs correction of making a plurality of discontinuous nozzles in the alignment order of the nozzles in the X-direction non-ejectable and of lowering visibility of a missing portion by using the remaining nozzles other than the nozzles made non-ejectable.

[Other Methods of Specifying Nozzle Group Including Abnormal Nozzle]

Figure 17:
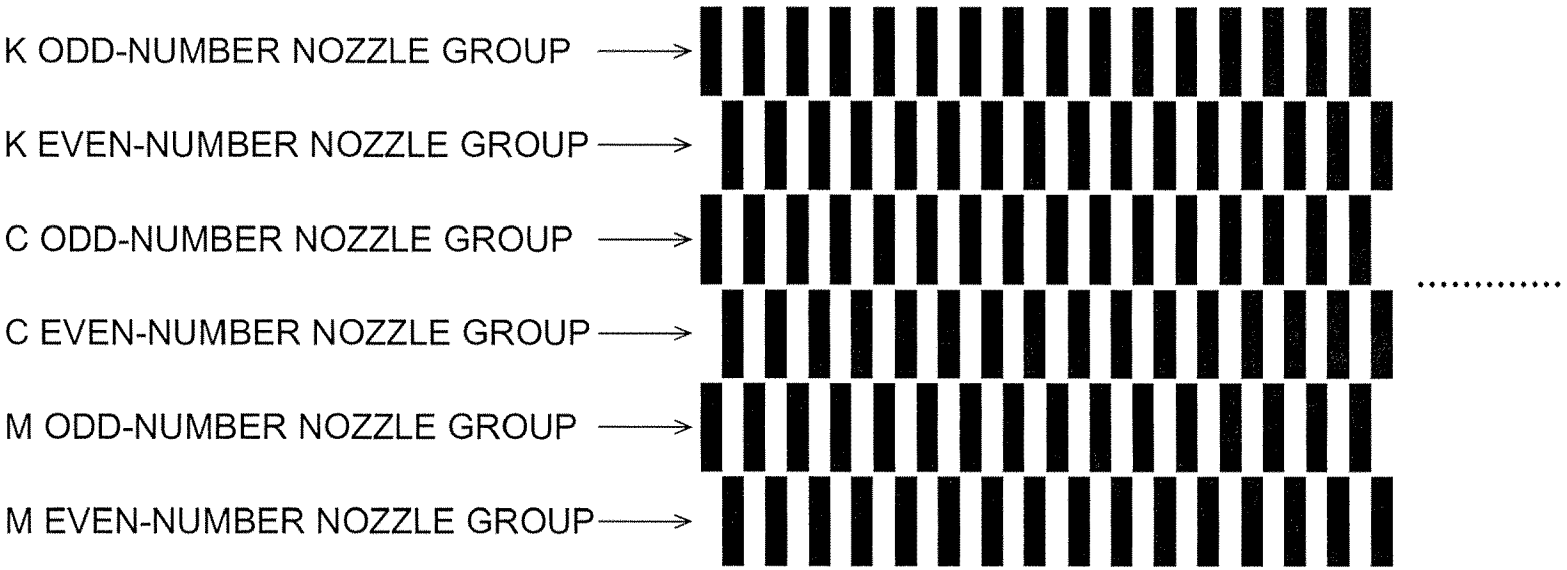
FIG. 17 is a diagram illustrating an example of a chart for specifying a nozzle group.

Other methods of specifying a nozzle group including an abnormal nozzle include a method of using an exclusive test chart for specifying nozzle group in the nozzle test region 84. FIG. 17 is an example of a chart for specifying nozzle group. The chart for specifying nozzle group illustrated in FIG. 17 corresponds to one form of the "first test chart".

In FIG. 17, a pattern on a first stage is a pattern of a line group recorded by the odd-number nozzle group in the inkjet head ejecting black ink. A pattern on a second stage is a pattern of the line group recorded by the even-number nozzle group in the inkjet head ejecting black ink. Black is indicated by K.

A pattern on a third stage is a pattern of a line group recorded by the odd-number nozzle group in the inkjet head ejecting cyan ink. A pattern on a fourth stage is a pattern of the line group recorded by the even-number nozzle group in the inkjet head ejecting cyan ink. Cyan is indicated by C.

A pattern on a fifth stage is a pattern of a line group recorded by the odd-number nozzle group in the inkjet head ejecting magenta ink. A pattern on a sixth stage is a pattern of the line group recorded by the even-number nozzle group in the inkjet head ejecting magenta ink. Magenta is indicated by M. The chart for specifying nozzle group includes those in different ink colors to be ejected among nozzle groups.

Although FIG. 17 is an enlarged diagram of schematic illustration and illustrates only a part of the line group, the chart for specifying nozzle group is printed by using all the nozzles in the inkjet head.

As exemplified in FIG. 17, the nozzle group including the abnormal nozzle can be specified by outputting the line chart having different stage constitutions according to the nozzle groups, specifying the stage in which the abnormality occurred, and by associating it with the corresponding nozzle group.

When it is detected that there is abnormality in the image from the test of the user image region 82, there can be a case where the color of the nozzle with abnormality can be specified and a case where it cannot. If the color of the nozzle with abnormality cannot be specified, the color of the abnormal nozzle and the nozzle group to which the abnormal nozzle belongs can be determined by printing the chart for specifying the nozzle group as in FIG. 17 on the nozzle test region 84.

A method of searching the nozzle group exemplified by using FIGS. 15 to 17 is carried out in a process from Step S16 to Step S18 in FIG. 2.

[Single Nozzle Specifying Method]

Subsequently, a specific example of a single nozzle specifying method for specifying an abnormal nozzle will be described. A single nozzle which is one abnormal nozzle can be determined from a test result of the nozzle test region 84 during a nozzle group search or after the nozzle group search. Since the abnormal nozzle is unstable, it is likely that the abnormal nozzle is not necessarily detected by the test of the nozzle test region 84.

However, when the nozzle group including the abnormal nozzle is specified once and the plural non-ejection correction is performed to this nozzle group, a streak does not occur on the user image and thus, the nozzle test pattern 86 can be printed on the nozzle test region 84 a plurality of times until a subsequent abnormal nozzle occurs. In this case, a waste sheet does not additionally occur.

Moreover, if the testing method which cannot specify the abnormal nozzle in the nozzle test region 84 is used, by switching the method to the testing method which can specify the abnormal nozzle, the single nozzle can be specified. Specifically, there can be a form in which the second nozzle testing method having been already described is switched to the first nozzle testing method.

As still another method, by sequentially cancelling non-ejection of the non-ejection nozzles belonging to the nozzle group to which the plural non-ejection correction is applied on the user image one by one and by detecting abnormality of the image through analysis of the respective images after the correction, the abnormal nozzle can be specified. In this case, as the result of generation of a waste sheet only when the abnormal nozzle is cancelled, one waste sheet is added.

The method of specifying the abnormal nozzle on the user image will be described by referring to FIGS. 18 to 21.

Figure 18:
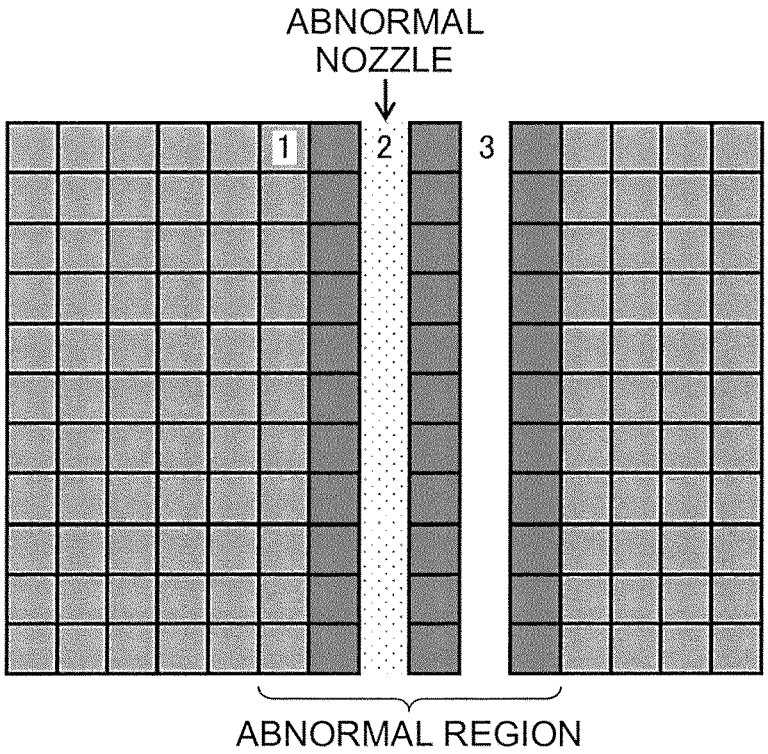
FIG. 18 is a schematic diagram illustrating an example in which non-ejection of one nozzle in the nozzle group which was made non-ejectable in FIG. 16 is cancelled.

FIG. 18 illustrates a state where non-ejection of the nozzle number 6 is cancelled from the state where the plural non-ejection correction of the nozzle group described in FIG. 16 has succeeded. In the example of FIG. 18, the nozzle group including the abnormal nozzle in the abnormal region includes three nozzles with the nozzle numbers 6, 8, and 10. Therefore, candidate nozzles of the abnormal nozzle are these three nozzles. It is assumed that they are called the candidate nozzles 1, 2, and 3 in the order of the nozzle numbers 6, 8, and 10. Indication of "1", "2", and "3" illustrated in FIG. 18 indicates positions of the candidate nozzles 1, 2, and 3, respectively. The same applies to FIGS. 19 to 21.

As illustrated in FIG. 18, when non-ejection of the candidate nozzle 1 is cancelled, while the non-ejection of the candidate nozzles 2 and 3 is maintained, and the correction in the plural non-ejection correction mode is performed to the nozzle groups of the candidate nozzles 2 and 3, a favorable image with a streak made invisible is obtained by means of the effect of the non-ejection correction. That is, it is determined that the candidate nozzle 1 is not an abnormal nozzle, and the abnormal nozzle remains unspecified.

Figure 19:
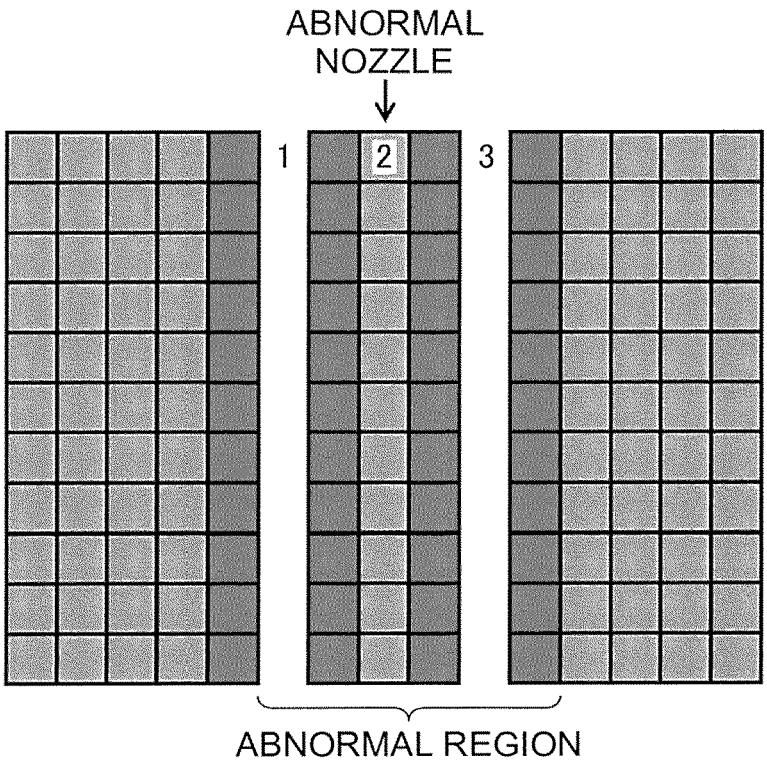
FIG. 19 is a schematic diagram illustrating an example in which non-ejection of one nozzle in the nozzle group which was made non-ejectable in FIG. 16 is cancelled.

FIG. 19 illustrates a state where non-ejection of the candidate nozzle 2, that is, the nozzle number 8 is cancelled from the state where the plural non-ejection correction of the nozzle group described in FIG. 16 has succeeded. As illustrated in FIG. 19, when the non-ejection of the candidate nozzle 1 is cancelled, while the non-ejection of the candidate nozzles 1 and 3 is maintained, and the correction in the plural non-ejection correction mode is performed to the nozzle groups of the candidate nozzles 1 and 3, since the candidate nozzle 2 for which the non-ejection has been cancelled is an abnormal nozzle, a streak is made visible in the image. That is, the non-ejection correction fails, and the candidate nozzle 2 is specified to be an abnormal nozzle.

Figure 20:
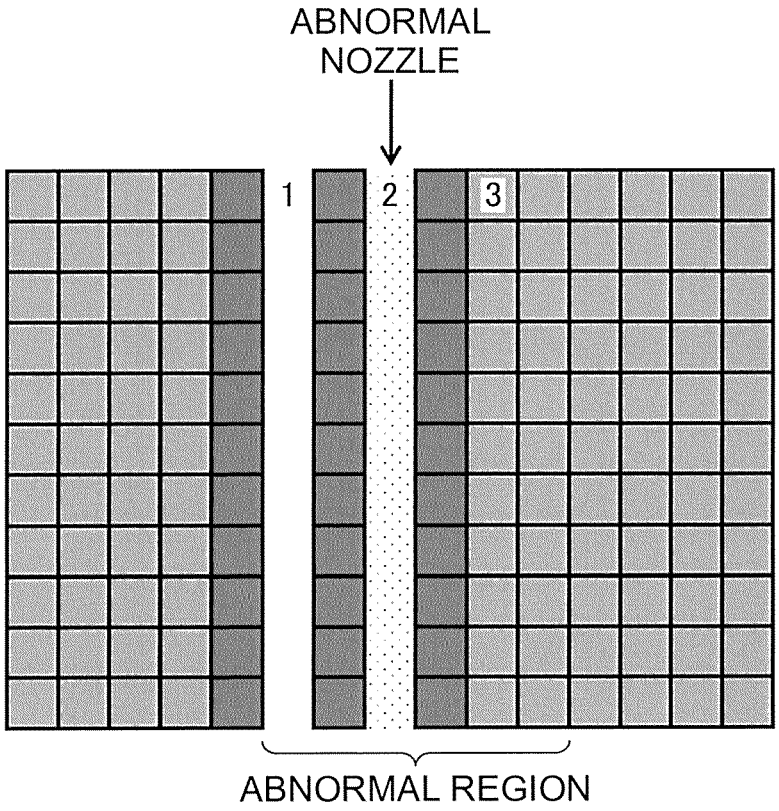
FIG. 20 is a schematic diagram illustrating an example in which non-ejection of one nozzle in the nozzle group which was made non-ejectable in FIG. 16 is cancelled.

FIG. 20 illustrates a state where non-ejection of the candidate nozzle 3, that is, the nozzle number 10 is cancelled from the state where the plural non-ejection correction of the nozzle group described in FIG. 16 has succeeded. As illustrated in FIG. 20, when the non-ejection of the candidate nozzle 3 is cancelled, while the non-ejection of the candidate nozzles 1 and 2 is maintained, and the correction in the plural non-ejection correction mode is performed to the nozzle groups of the candidate nozzles 1 and 2, a favorable image with a streak made invisible is obtained by means of the effect of the non-ejection correction. That is, it is determined that the candidate nozzle 3 is not an abnormal nozzle, and the abnormal nozzle remains unspecified.

An order of execution of FIGS. 18, 19, and 20 does not matter. If the non-ejection is sequentially cancelled in the order of the candidate nozzles 1, 2, and 3, the abnormal nozzle is specified at a stage where the non-ejection of the candidate nozzle 2 is cancelled, and thus, execution of the plural non-ejection correction for cancelling the non-ejection of the candidate nozzle 3 described in FIG. 20 can be omitted. That is, when the abnormal nozzle is specified, the processing for the remaining candidate nozzles can be omitted.

If it is made certain that the candidate nozzle 1 is not an abnormal nozzle in FIG. 18, when non-ejection of the subsequent candidate nozzle 2 is to be cancelled, the candidate nozzle 1 does not have to be made non-ejectable. Non-ejection of the nozzle which is confirmed not to be an abnormal nozzle in the candidate nozzles may be cancelled after that. After specification of the abnormal nozzle is completed, it is desirable that non-ejection of the other nozzles is cancelled except the specified abnormal nozzle. Then, the correction in the single non-ejection correction mode is performed by making the specified abnormal nozzle non-ejectable.

Figure 21:
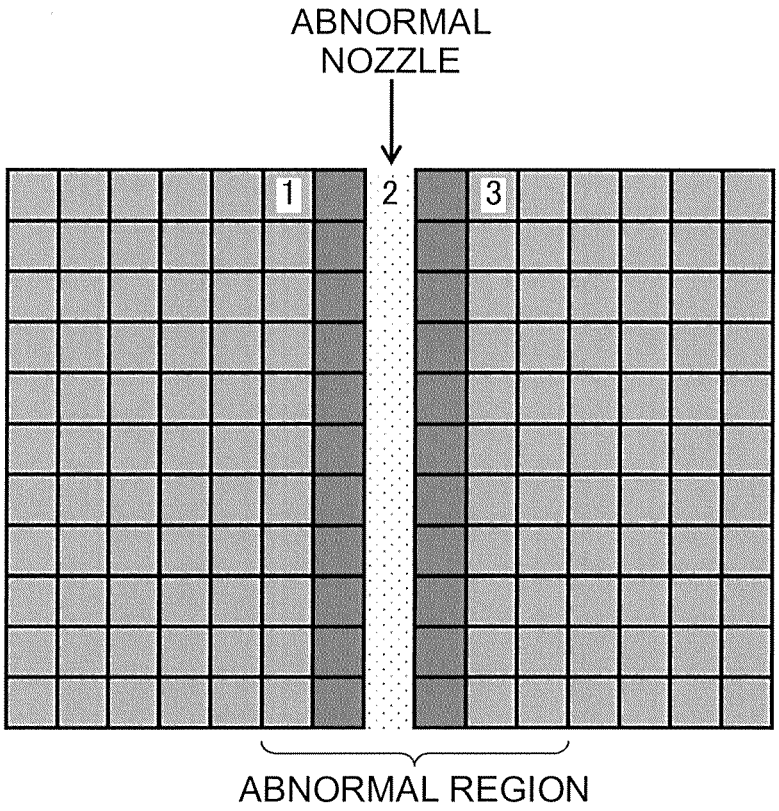
FIG. 21 is a schematic diagram illustrating a state where the single non-ejection correction was performed by making a specified abnormal nozzle non-ejectable.

FIG. 21 illustrates a state where the single non-ejection correction is performed by making the specified abnormal nozzle non-ejectable. In FIG. 21, the non-ejection of the candidate nozzles 1 and 3 is cancelled. The abnormal nozzle is made non-ejectable, and a favorable image in which the streak is made invisible is obtained by means of the effect of the single non-ejection correction.

By employing the method as above, a streak occurring on the user image can be specified and corrected while a waste sheet is minimized.

[Second Example of Image Correcting Method: When Abnormal Nozzle Cannot be Specified]

In the description above, the case where the abnormal nozzle can be specified is described. However, the abnormal nozzle is unstable, and the abnormal state can be recovered to a normal state in some cases. When the abnormal nozzle is recovered, specification of the nozzle group including the abnormal nozzle or specification of the abnormal nozzle cannot be accomplished in subsequent nozzle-group specification processing or abnormal nozzle specification processing. In that case, non-ejection set to the nozzle group may be cancelled.

Figure 22:
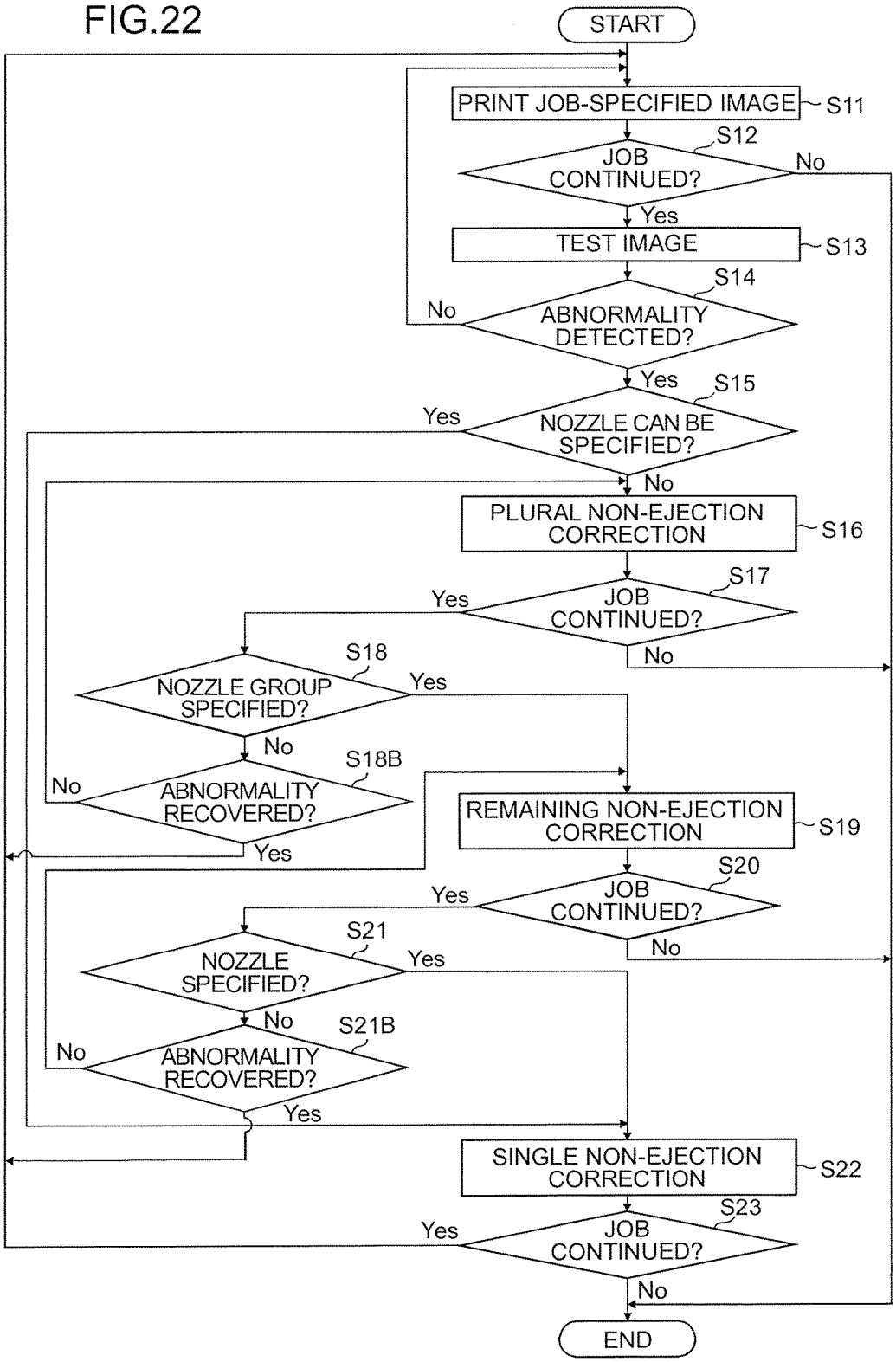
FIG. 22 is a flowchart illustrating a procedure of a second example of the image correcting method in the image forming apparatus according to the embodiment.

FIG. 22 is a flowchart including handling of the case where the abnormality of a nozzle is not reproduced. In FIG. 22, the step which is the same or similar to that in the flowchart described in FIG. 2 are given the same reference step number, and the description will be omitted.

In the flowchart illustrated in FIG. 22, if it is No determination at Step S18, the routine proceeds to Step S18B. At Step S18B, the controller determines whether the abnormality of the nozzle has been recovered or not. For example, the controller makes determination at Step S18B based on whether an unconfirmed nozzle group remains in the candidate nozzle groups including the abnormal nozzle or not. In the case where the nozzle groups are divided into two kinds, that is, the even-number nozzle group and the odd-number nozzle group, the candidate nozzle groups including the abnormal nozzle are the two nozzle groups, that is, the even-number nozzle group and the odd-number nozzle group.

When the plural non-ejection correction is performed by making one nozzle group of the plurality of nozzle group candidates non-ejectable, if a streak occurs, it makes No determination at each of Step S18 and Step S18B.

In the case of the No determination at Step S18B, the routine returns to Step S16, and the nozzle group to be made non-ejectable is changed, and the plural non-ejection correction is performed.

Even if a streak is made invisible when the plural non-ejectable correction is performed by making one nozzle group in the plurality of nozzle group candidates non-ejectable, if other unconfirmed nozzle group candidates remain, it makes No determination at each of Step S18 and Step S18B.

On the other hand, when the plural non-ejection correction is performed by making each of the plurality of nozzle group candidates non-ejectable, if all the streaks are made invisible in either cases, it can be determined that the abnormality has been recovered at Step S18B. For example, if the plural non-ejection correction is performed by making the odd-number nozzle group non-ejectable, too, the streak is made invisible, and if the streak is made invisible when the plural non-ejection correction is performed by making the even-number nozzle group non-ejectable, it can be determined that the abnormality has been recovered at Step S18B.

When it is determined that the abnormality has been recovered at Step S18B, the non-ejection of the nozzle group by the plural non-ejection correction mode is cancelled, the routine returns to Step S11, and normal printing is carried out.

Moreover, in the flowchart illustrated in FIG. 22, in the case of No determination at Step S21, the routine proceeds to Step S21B. At Step S21B, the controller determines whether the abnormality of the nozzle has been recovered or not. For example, the controller carries out the determination at Step S21B based on whether or not an unconfirmed candidate nozzle remains in the nozzle group.

If the streak is made invisible when the non-ejection of one candidate nozzle in the plurality of candidate nozzle candidates is cancelled and the remaining non-ejection correction (Step S19) is performed, and if other unconfirmed candidate nozzles remain, it makes No determination at each step of Step S21 and Step S21B.

In the case of the No determination at Step S21B, the routine returns to Step S19, and the candidate nozzle for which non-ejection is to be cancelled is changed, and the remaining non-ejection correction is performed.

On the other hand, when the non-ejection is cancelled for each of the plurality of candidate nozzles and the remaining non-ejection correction is performed, if all the streaks are made invisible in either cases, it can be determined that the abnormality has been recovered at Step S21B. In the example described by FIGS. 18 to 20, if the streak is made invisible when the non-ejection of the candidate nozzle 1 is cancelled and the remaining non-ejection correction is performed, if the streak is made invisible when the non-ejection of the candidate nozzle 2 is cancelled and the remaining non-ejection correction is performed, and if the streak is made invisible when the non-ejection of the candidate nozzle 3 is cancelled and the remaining non-ejection correction is performed, it can be determined that the abnormality has been recovered at Step S21B.

If it is determined that the abnormality has been recovered at Step S21B, the non-ejection of the nozzle group by the plural non-ejection correction mode is cancelled, the routine returns to Step S11, and normal printing is carried out.

As a variation of FIG. 22, there can be a form in which the Step S18B is omitted.

[Third Example of Image Correcting Method]

Figure 23:
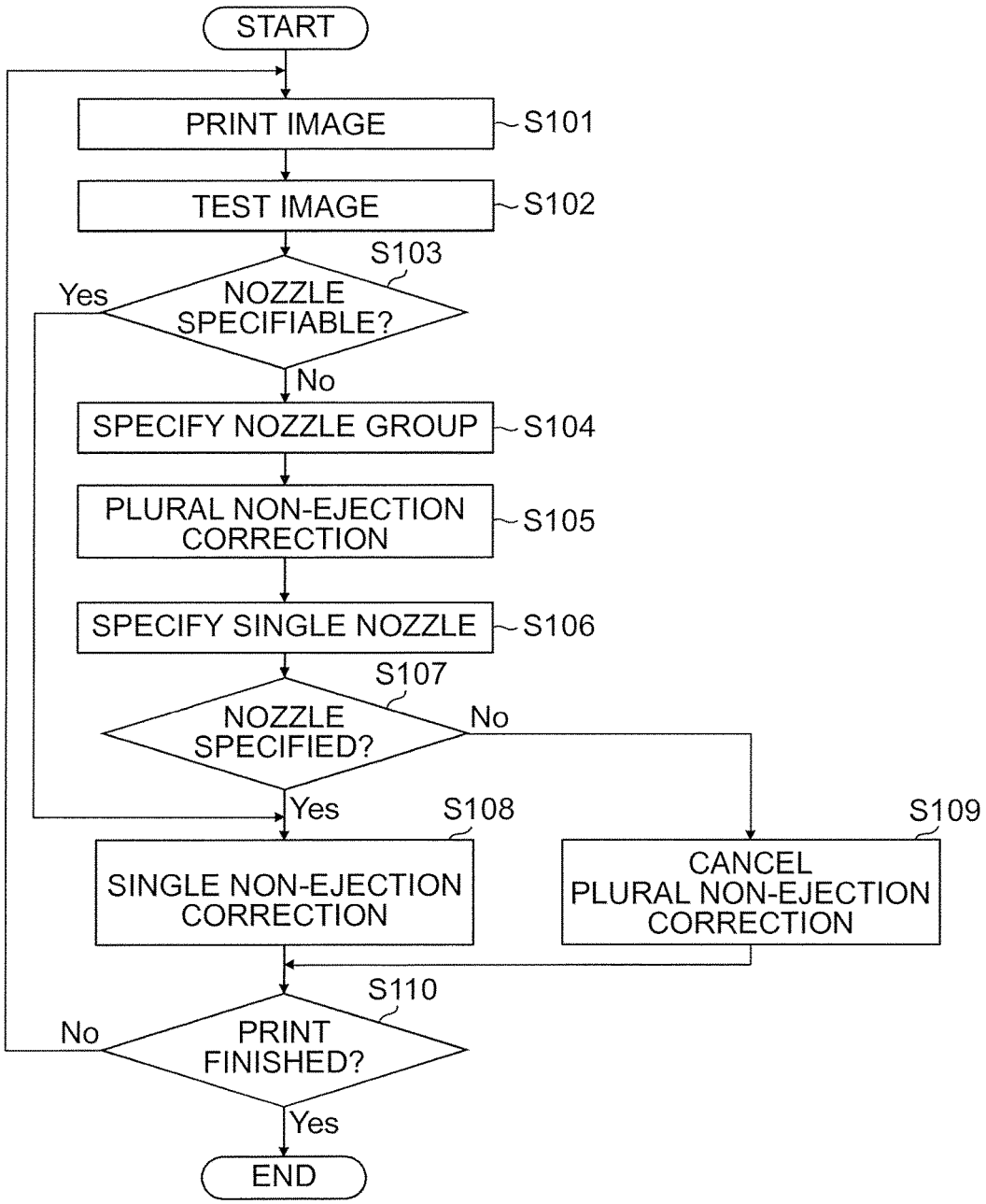
FIG. 23 is a flowchart illustrating a procedure of a third example of the image correcting method in the image forming apparatus according to the embodiment.

FIG. 23 is a flowchart illustrating a procedure of a third example of the image correcting method in the image forming apparatus according to the embodiment. FIG. 23 is expressed as a superordinate concept than the flowchart described in FIG. 2 and is not limited to processing of one job but also includes forms of processing across a plurality of jobs. Each Step in the flowchart illustrated in FIG. 23 is executed by the inkjet printing apparatus including the controller.

At Step S101, the inkjet printing apparatus prints an image. At a print step at Step S101, printing of a user image specified in accordance with an instruction of a job is carried out.

At Step S102, the inkjet printing apparatus conducts a test of a printed image. Contents of an image testing step at Step S102 are similar to those at Step S13 in FIG. 2. If abnormality in the image is not detected at the image testing step at Step S102 in FIG. 23, normal print processing is continued. If abnormality in the image is detected at the image testing step at Step S102, the routine proceeds to Step S103.

At Step S103, the controller determines whether an abnormal nozzle can be specified or not. Contents of a nozzle specifiability determination step at Step S103 are similar to those at Step S15 in FIG. 2.

At Step S103 in FIG. 23, if the controller determines that the abnormal nozzle cannot be specified, the routine proceeds to Step S104, and processing of specifying a nozzle group is carried out.

At a nozzle-group specification step at Step S104, a nozzle group is specified by the nozzle group searching method exemplified by using FIGS. 15 to 17, for example. At Step S104, correction in the plural non-ejection correction mode can be carried out.

If a nozzle group including the abnormal nozzle is specified by Step S104, the routine proceeds to Step S105. At Step S105, the plural non-ejection correction for correction by making the nozzle group specified at Step S104 non-ejectable is performed.

After that, at Step S106, single nozzle specification processing for specifying the abnormal nozzle is carried out. The single nozzle specification step at Step S106 may specify the abnormal nozzle from a nozzle test pattern of the nozzle test region 84 or may specify the abnormal nozzle from the user image as described from FIGS. 18 to 20.

After Step S106 in FIG. 23 is carried out, at Step S107, the controller determines whether the abnormal nozzle has been specified or not. If the abnormal nozzle can be specified by the single nozzle specification step at Step S106, the determination at Step S107 becomes Yes determination, and the routine proceeds to Step S108. Contents of the single non-ejection correction step at Step S108 are similar to those at Step S22 in FIG. 2. Moreover, if the abnormal nozzle can be specified at Step S103, the routine proceeds to Step S108.

On the other hand, if the abnormal nozzle cannot be specified in the end by the single nozzle specification step at Step S106, the determination at Step S107 becomes No determination, and the routine proceeds to Step S109. At Step S109, the controller cancels the plural non-ejection correction which made the nozzle group specified at Step S104 non-ejectable. That is, at Step S109, non-ejection of the nozzle group is cancelled. The plural non-ejection correction cancellation step at Step S109 corresponds to processing when it is determined at Step S21B in FIG. 22 that the abnormality has been recovered.

After Step S108 or Step S109 in FIG. 23, the controller determines whether the print is to be finished or not at Step S110. The determination whether to finish or not here may be end determination of one job or may be end determination of a printing operation across a plurality of jobs.

For example, if print of a number of printed sheets of the specified job has not been completed, the controller can determine that the print should be continued at Step S110. Alternatively, even if one job has been completed, when another job is continuously executed, the controller can determine that the print should be continued at Step S110. If the controller determines that the print should be continued at Step S110, the routine returns to Step S101. When the routine returns from Step S110 to Step S101, the single non-ejection correction at Step S108 is maintained after that, and processing from Step S101 to Step S110 is carried out to occurrence of new nozzle abnormality.

At Step S110, if the controller determines that the print should be finished, the flowchart in FIG. 23 is finished.

A combination of the plural non-ejection correction step at Step S105 and the single non-ejection correction step at Step S108 corresponds to one form of the "correction step".

[Fourth Example of Image Correcting Method]

Figure 24:
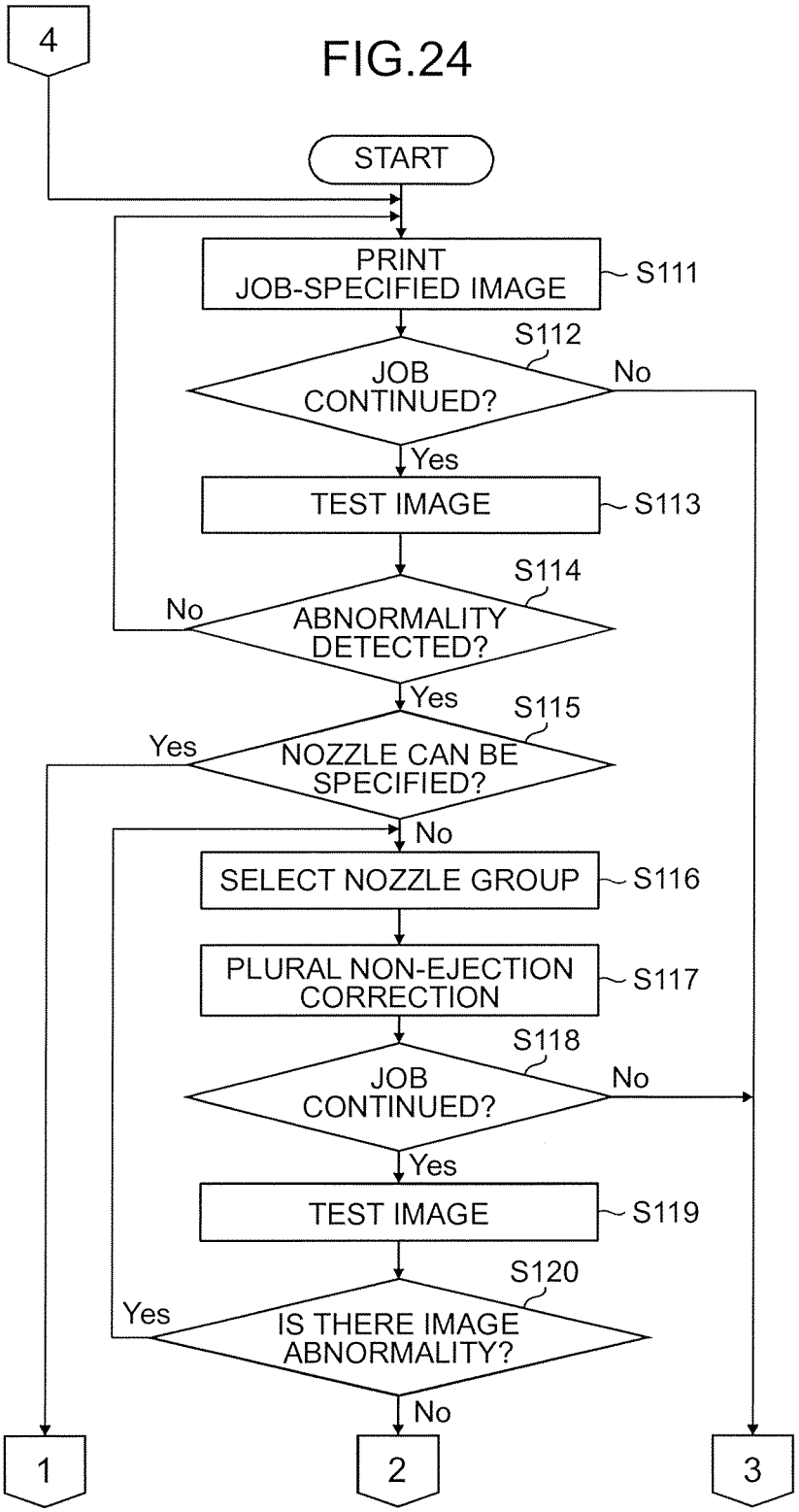
FIG. 24 is a flowchart illustrating a procedure of a fourth example of the image correcting method in the image forming apparatus according to the embodiment.
Figure 25:
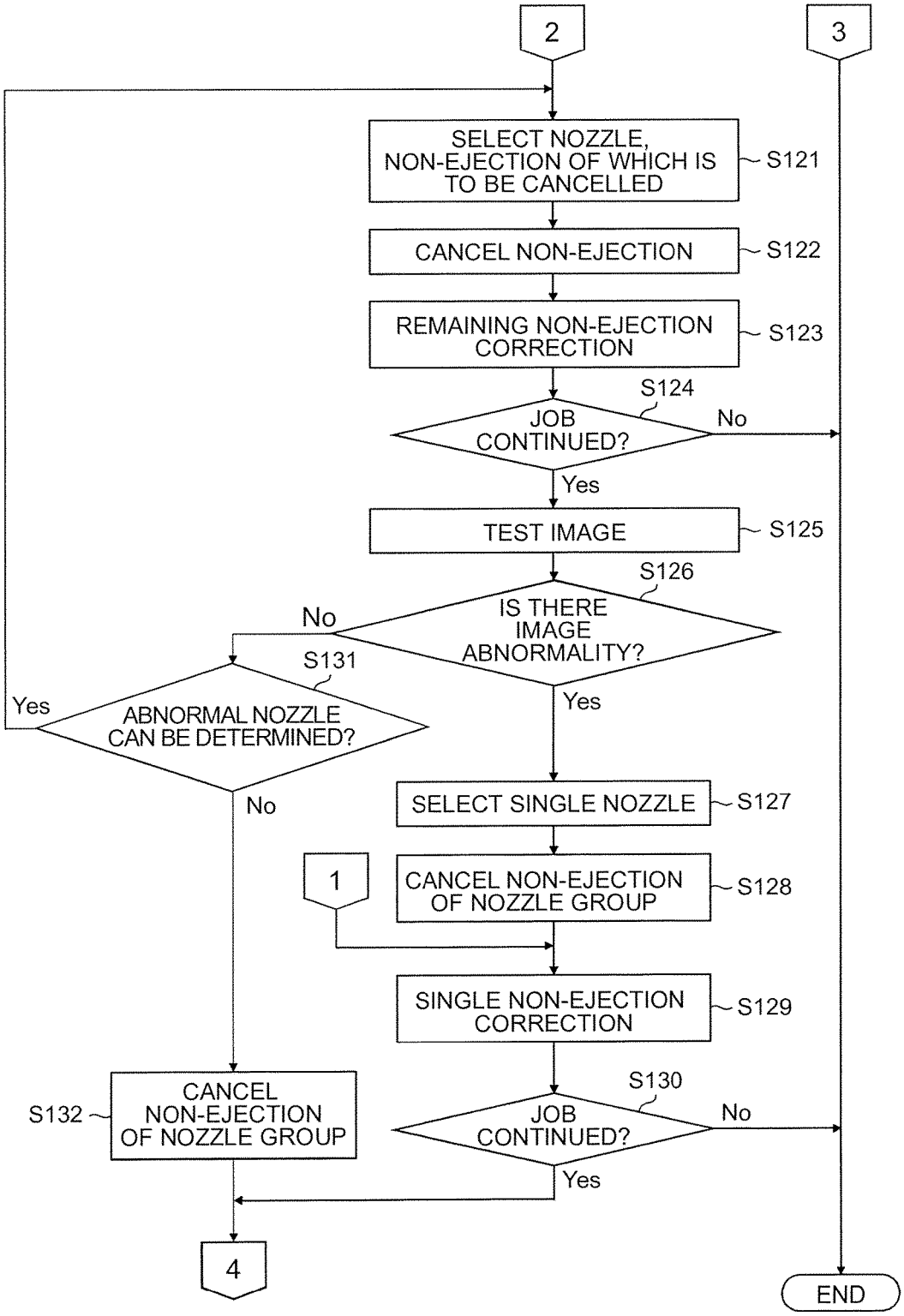
FIG. 25 is a flowchart illustrating a procedure of the fourth example of the image correcting method in the image forming apparatus according to the embodiment.

FIGS. 24 and 25 are flowcharts illustrating a procedure of a fourth example of the image correcting method in the image forming apparatus according to the embodiment.

The fourth example illustrated in the flowcharts in FIGS. 24 and 25 is a variation of the first example described in FIG. 2. The fourth example is an example in which the specification processing of a nozzle group including an abnormal nozzle and the specification processing of a single nozzle (that is, the abnormal nozzle) are both carried out based on a test on the user image.

Each step at Steps S111, S112, S113, S114, and S115 in FIG. 24 is similar to each step at Steps S11, S12, S13, S14, and S15 in FIG. 2 and thus, description will be omitted. However, if it is determined that the nozzle can be specified at Step S115 in FIG. 24, the routine proceeds to Step S129 in FIG. 25.

At Step S115 in FIG. 24, if it is determined that the nozzle cannot be specified, the routine proceeds to Step S116.

At Step S116, the controller selects a nozzle group. At a nozzle-group selection step at Step S116, processing of selecting one nozzle group from a plurality of nozzle group candidates is carried out. For example, if there are two nozzle group candidates of the odd-number nozzle group and the even-number nozzle group, processing of selecting either one of the nozzle groups is applicable.

Subsequently, at Step S117, the plural non-ejection correction is performed. At the plural non-ejection correction step at Step S117, the plural non-ejection correction is performed by making the nozzle group selected by Step S116 non-ejectable.

At Step S118, the controller determines whether the job should be continued or not. At Step S118, if the controller determines that the job should be continued, the routine proceeds to Step S119.

At Step S119, the controller conducts a test of the image corrected by the plural non-ejection correction step at Step S117 and printed. The image testing step at Step S119 is a step of testing whether there is abnormality in the image of the user image region 82 or not, similarly to the image testing step at Step S113.

At Step S120, the controller determines whether or not there is abnormality in the image based on a test result of Step S119.

At Step S120, if it is determined to be "there is abnormality", the routine returns to Step S116, and selection of a nozzle group is made again. When the routine returns from Step S120 to Step S116, a nozzle group different from the nozzle group selected the previous time is selected.

At Step S120, if it is determined to be "no abnormality", the routine proceeds to Step S121 in FIG. 25. The determination of "no abnormality" at Step S120 in FIG. 24 can be understood as determination indicating that a nozzle group including an abnormal nozzle has been specified.

At Step S121 in FIG. 25, the controller selects a nozzle for which non-ejection is cancelled. In the example in FIG. 16, it corresponds to selection of any one candidate nozzle in the candidate nozzles 1, 2, and 3.

At Step S122 in FIG. 25, the controller cancels non-ejection of the nozzle selected at a non-ejection cancelled nozzle selection step at Step S121.

At Step S123, the inkjet printing apparatus carries out the remaining non-ejection correction which makes a non-ejection portion invisible while non-ejection of the remaining nozzles in the nozzle group is maintained.

At Step S124, the controller determines whether the job should be continued or not. At Step S124, if the controller determines that the job should be continued, the routine proceeds to Step S125.

At Step S125, the controller conducts a test of the image corrected by the remaining non-ejection correction step at Step S123 and printed. The image testing step at Step S123 is similar to the image testing step at Step S113 (see FIG. 24).

At Step S126 in FIG. 25, the controller determines whether there is abnormality in the image or not based on a test result at Step S125.

At Step S126, if it is determined to be "there is abnormality", the routine proceeds to Step S127. At Step S127, the controller selects a single nozzle which is the abnormal nozzle. The controller cancels non-ejection at Step S122 and specifies that the nozzle in which abnormality of the image occurred is the abnormal nozzle. The determination at Step S126 corresponds to determination on whether the abnormal nozzle has been specified or not.

At Step S128, the controller cancels non-ejection of the nozzle group and proceeds to the single non-ejection correction step at Step S129.

The single non-ejection correction step at Step S129 is similar to Step S22 in FIG. 2. That is, the correction in the single non-ejection correction mode is carried out by making the abnormal nozzle which is the single nozzle selected at Step S127 in FIG. 25 non-ejectable.

At Step S130, the controller determines whether the job should be continued or not. At Step S130, if the controller determines that the job should be continued, the routine returns to Step S111 in FIG. 24. When the routine returns from Step S130 to Step S111, the single non-ejection correction at Step S129 is maintained after that, and processing at Step S111 and after is applied to occurrence of new nozzle abnormality.

If it is determined to be "no abnormality" by the determination processing at Step S126 in FIG. 25, the routine proceeds to Step S131. At Step S131, the controller determines whether it is likely that an abnormal nozzle can be determined or not. The determination processing at Step S131 is similar to the determination processing described at Step S21B in FIG. 22. If a candidate nozzle which is uncertain whether it is an abnormal nozzle or not remains in the nozzle group, it is likely that the abnormal nozzle can be determined in the determination processing at Step S131 and thus, it becomes "Yes determination" and the routine returns to Step S121, and a nozzle for which non-ejection is cancelled is selected again.

On the other hand, in the determination processing at Step S131, if it is confirmed that none of the nozzles included in the nozzle group is an abnormal nozzle, the abnormality has been recovered, and the abnormal nozzle cannot be determined and thus, it makes "No determination", and the routine proceeds to Step S132.

At Step S132, the controller cancels non-ejection of the nozzle group and the routine returns to Step S111 in FIG. 24.

At Step S115 in FIG. 24, if it is determined that the nozzle can be specified, the routine proceeds to Step S129 in FIG. 25, and the correction in the single non-ejection correction mode is carried out by making the specified abnormal nozzle non-ejectable.

If the controller determines that the job should be finished at any one step of Steps S112 and S118 in FIG. 24 and Steps S124 and S130 in FIG. 25, the job is finished, and the flowcharts in FIGS. 24 and 25 are finished.

Each of the plural non-ejection correction step at Step S117 in FIG. 24 and the remaining non-ejection correction step at Step S123 in FIG. 25 corresponds to one form of the "plural non-ejection step".

A combination of the plural non-ejection correction step at Step S117 and the remaining non-ejection correction step at Step S123, and the single non-ejection correction step at Step S129 corresponds to one form of the "correction step".

[Fifth Example of Image Correcting Method]

Figure 26:
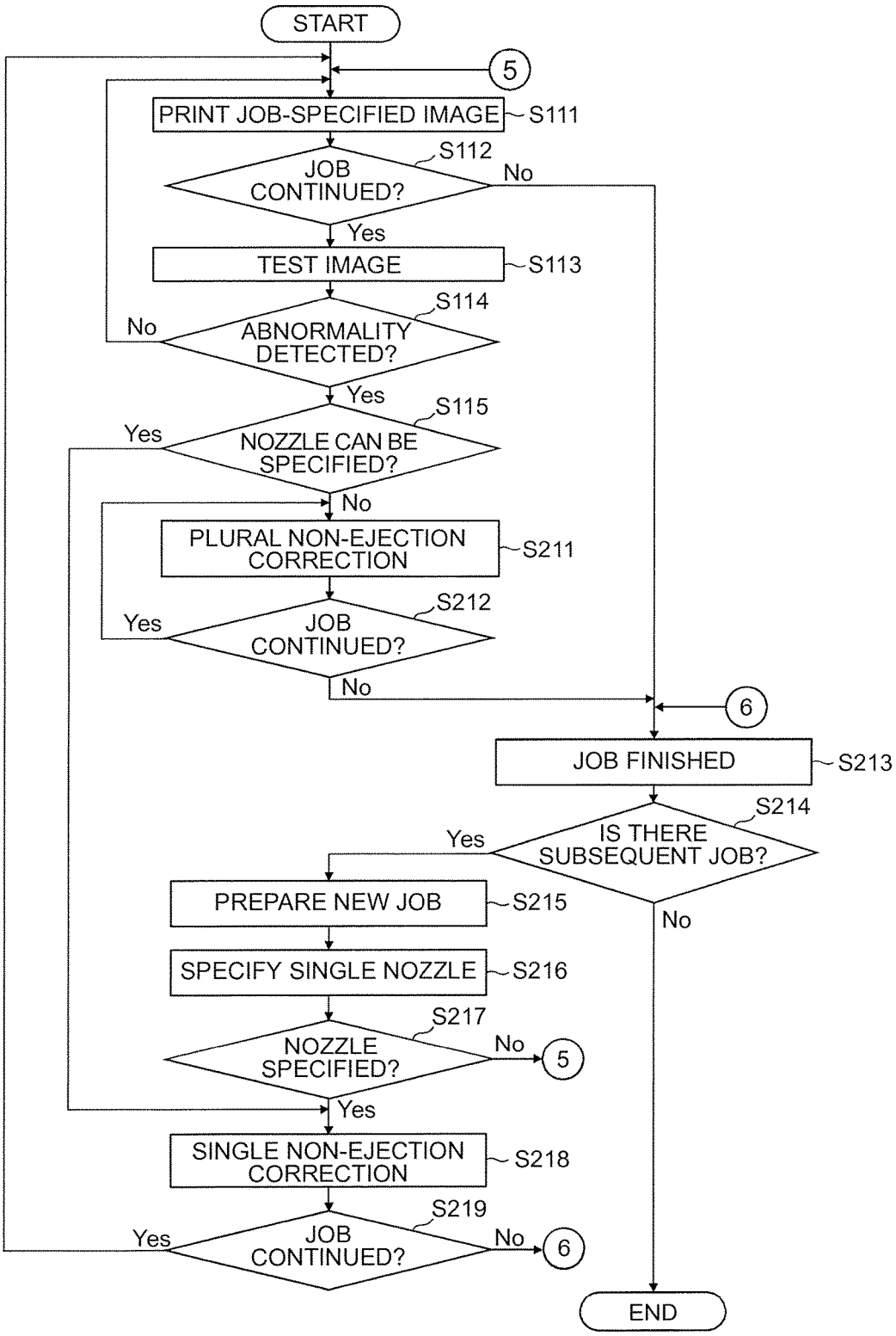
FIG. 26 is a flowchart illustrating a procedure of a fifth example of the image correcting method in the image forming apparatus according to the embodiment.

FIG. 26 is a flowchart illustrating a procedure of a fifth example of the image correcting method in the image forming apparatus according to the embodiment. The fifth example illustrated in the flowchart in FIG. 26 is an example of a form in which timing for switching from the plural non-ejection correction mode to the single non-ejection correction mode is matched with job switching timing.

In the flowchart in FIG. 26, the same steps as those in the flowcharts illustrated in FIGS. 24 and 25 are given the same step numbers and the description will be omitted.

At Step S115 in FIG. 26, if it is determined that the nozzle cannot be specified, the routine proceeds to Step S211. The plural non-ejection correction step at Step S211 includes the processing of the nozzle group specification step described at Step S104 in FIG. 23 and performs the operation similar to the plural non-ejection correction step at Step S105. That is, the correction in the plural non-ejection correction mode is performed by specifying the nozzle group including the abnormal nozzle.

At Step S212, the controller determines whether the job should be continued or not. At Step S212, if the controller determines that the job should be continued, the routine returns to Step S211, and print by the plural non-ejection correction is continued.

If the controller determines that the job should be finished at Step S212, the routine proceeds to Step S213, and the job is finished. Moreover, if the controller determines that the job should be finished at Step S112, too, the routine proceeds to Step S213, and the job is finished.

Subsequently, at Step S214, the controller determines whether there is a subsequent job or not. If it is determined that there is a subsequent job at Step S214, the routine proceeds to Step S215, and preparation is made for performing a new job. The preparation for the job can include various settings such as setting of a print condition and setting of a parameter.

Moreover, at Step S216, the single nozzle specification processing of specifying an abnormal nozzle is carried out. Contents of the single nozzle specification step at Step S216 are similar to those at Step S106 in FIG. 23.

At Step S217 in FIG. 26, the controller determines whether the abnormal nozzle has been specified or not. If the abnormal nozzle can be specified by the single nozzle specification step at Step S216, the determination at Step S217 becomes Yes determination, and the routine proceeds to Step S218. Contents of the single non-ejection correction step at Step S218 are similar to those at Step S108 in FIG. 23. By means of Step S18, an image corrected by the single non-ejection correction mode is printed. The image printed by Step S218 is an image according to job specification set at Step S215.

After printing by Step S218, the controller determines whether the job should be continued or not at Step S219. At Step S219, if the controller determines that the job should be continued, the routine returns to Step S111.

When the routine returns from Step S219 to Step S111, the single non-ejection correction at Step S218 is maintained, and print is continued.

At Step S217, if it is determined that the abnormal nozzle cannot be specified, the routine returns to Step S111, and print is carried out in a state where non-ejection of the nozzle group is canceled.

At Step S219, if the controller determines that the job should be finished, the routine proceeds to Step S213, and the job is finished.

At Step S214, if it is determined that there is no subsequent job, the flowchart in FIG. 26 is finished.

A combination of the plural non-ejection correction step at Step S211 and the single non-ejection correction step at Step S218 corresponds to one form of the "correction step".

[Constitution Example of Inkjet Printing Apparatus]

Figure 27:
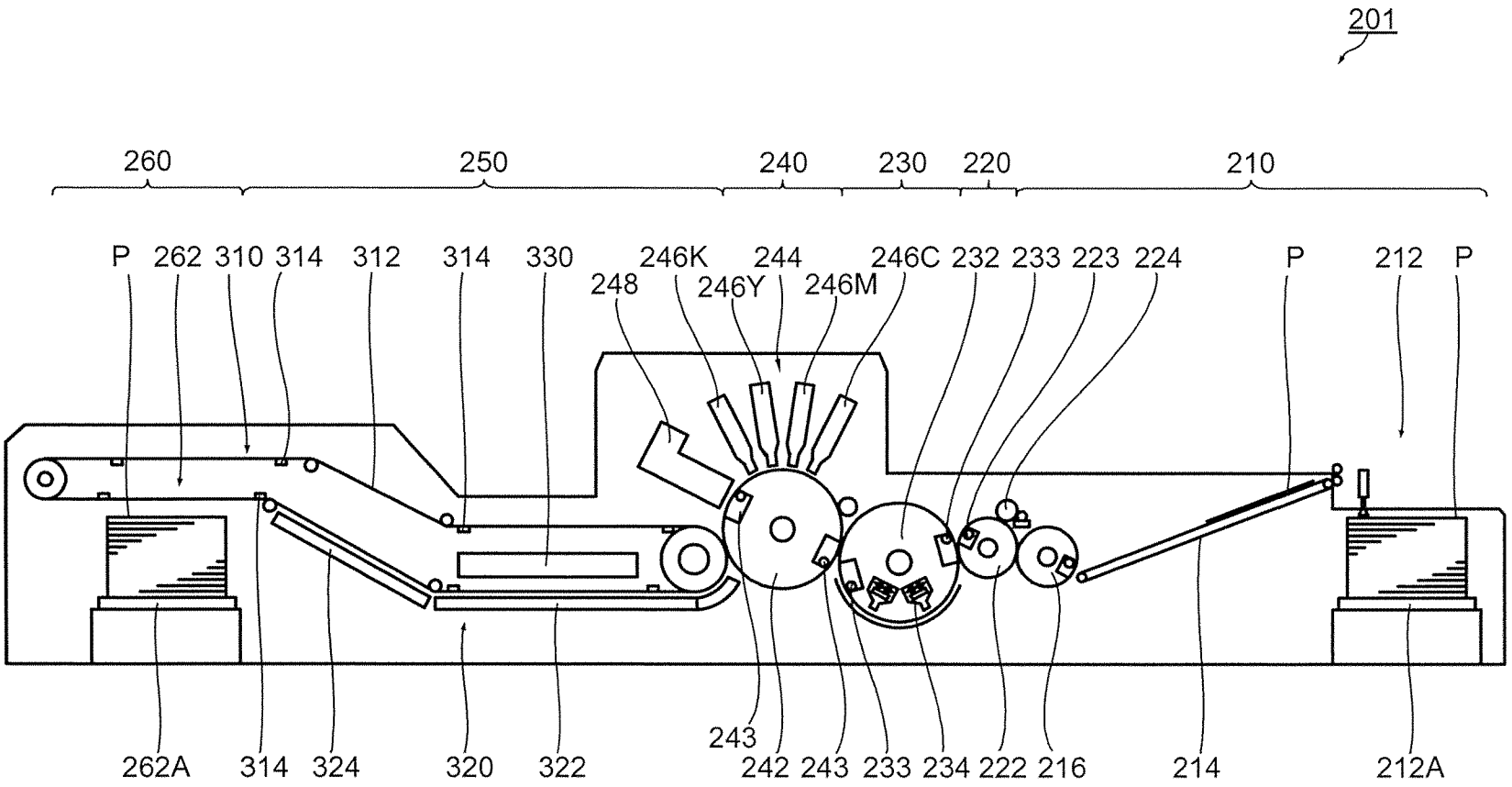
FIG. 27 is a side view illustrating constitution of the inkjet printing apparatus according to the embodiment.

FIG. 27 is a side view illustrating constitution of an inkjet printing apparatus 201 according to the embodiment. The term "printing apparatus" has the same meaning as the terms such as a printing machine, a printer, an image recording apparatus, an image forming apparatus, an image output apparatus and the like.

The inkjet printing apparatus 201 is a line-head type inkjet printing apparatus of a sheet-feed type which prints a color image on a sheet of paper P by a line head. The ink-jet printing apparatus 201 includes a sheet feeding unit 210, a treatment liquid applying unit 220, a treatment liquid drying unit 230, a drawing unit 240, an ink drying unit 250, and an integrating unit 260.

The sheet feeding unit 210 automatically feeds sheets P one by one. The sheet feeding unit 210 includes a sheet feeding device 212, a feeder board 214, and a sheet feeding drum 216. A type of the sheet P is not particularly limited, but a printing sheet mainly made of cellulose such as high quality paper, coated paper, art paper and the like can be used, for example. The sheet P corresponds to one form of a medium on which an image is recorded. The sheets P are loaded on a sheet feeding table 212A in a state of a bundle in which a large number of sheets are stacked.

The sheet feeding device 212 takes out the sheets P in the bundle state set on the sheet feeding table 212A one by one from the top and feeds them to the feeder board 214. The feeder board 214 transfers the sheet P received from the sheet feeding device 212 to the sheet feeding drum 216.

The sheet feeding drum 216 receives the sheet P fed from the feeder board 214 and transfers the received sheet P to the treatment liquid applying unit 220.

The treatment liquid applying unit 220 applies a treatment liquid on the sheet P. The treatment liquid is a liquid including a function of coagulating, insolubilizing or thickening of a color material component in the ink. The treatment liquid applying unit 220 includes a treatment liquid application drum 222 and a treatment liquid applying device 224.

The treatment liquid application drum 222 receives the sheet P from the sheet feeding drum 216 and transfers the received sheet P to the treatment liquid drying unit 230. The treatment liquid application drum 222 includes a gripper 223 on its periphery and winds the sheet P on the peripheral surface and conveys it by gripping a leading edge portion of the sheet P by the gripper 223 and rotating it.

The treatment liquid applying device 224 applies the treatment liquid on the sheet P conveyed by the treatment liquid application drum 222. The treatment liquid is applied by a roller.

The treatment liquid drying unit 230 applies drying processing to the sheet P on which the treatment liquid is applied. The treatment liquid drying unit 230 includes a treatment liquid drying drum 232 and a hot-air blower 234. The treatment liquid drying drum 232 receives the sheet P from the treatment liquid application drum 222 and transfers the received sheet P to the drawing unit 240. The treatment liquid drying drum 232 includes a gripper 233 on its peripheral surface. The treatment liquid drying drum 232 conveys the sheet P by gripping the leading edge portion of the sheet P by the gripper 233 and rotating it.

The hot-air blower 234 is installed inside the treatment liquid drying drum 232. The hot-air blower 234 blows hot air to the sheet P conveyed by the treatment liquid drying drum 232 and dries the treatment liquid.

The drawing unit 240 includes a drawing drum 242, a head unit 244, and an in-line scanner 248. The drawing drum 242 receives the sheet P from the treatment liquid drying drum 232 and transfers the received sheet P to the ink drying unit 250. The drawing drum 242 includes a gripper 243 on its peripheral surface and winds the sheet P on the peripheral surface and conveys it by gripping the leading edge of the sheet P by the gripper 243 and rotating it. The drawing drum 242 includes a suction mechanism, not shown, and suctions the sheet P wound around the peripheral surface on the peripheral surface and conveys it. The suctioning uses a negative pressure. The drawing drum 242 includes a large number of suction holes on its peripheral surface and suctions the sheet P on the peripheral surface by suctioning from an inside through the suction holes.

The head unit 244 includes an inkjet heads 246C, 246M, 246Y, and 246K. The inkjet head 246C is a recording head which ejects an ink droplet in cyan (C). The ink-jet head 246M is a recording head which ejects an ink droplet in magenta (M). The ink-jet head 246Y is a recording head which ejects an ink droplet in yellow (Y). The inkjet head 246K is a recording head which ejects an ink droplet in black (K). To each of the ink-jet heads 246C, 246M, 246Y, and 246K, the ink is supplied from an ink tank, not shown, which is a supply source of the ink in corresponding color through a pipeline path, not shown.

Each of the inkjet heads 246C, 246M, 246Y, and 246K is constituted by a line head corresponding to a sheet width and each of nozzle surfaces is disposed by facing the peripheral surface of the drawing drum 242. The sheet width here refers to a sheet width in a direction orthogonal to the conveyance direction of the sheet P. The inkjet heads 246C, 246M, 246Y, and 246K are disposed at a certain interval along the conveyance path of the sheet P by the drawing drum 242.

Though not shown, on the nozzle surface of each of the inkjet heads 246C, 246M, 246Y, and 246K, a plurality of nozzles which are ejection ports of ink is aligned two-dimensionally. The "nozzle surface" refers to an ejection surface on which the nozzle is formed and has the same meaning as the term "ink ejection surface" or "nozzle forming surface". The nozzle alignment of the plurality of nozzles aligned two-dimensionally is called "two-dimensional nozzle alignment".

Each of the inkjet heads 246C, 246M, 246Y, and 246K can be constituted by connecting a plurality of head modules in a sheet width direction. Each of the inkjet heads 246C, 246M, 246Y, and 246K is a full-line type recording head having a nozzle row capable of image recording with specified recording resolution in one session of scanning of the whole recording region of the sheet P with respect to the sheet width direction orthogonal to the conveyance direction of the sheet P. The full-line type recording head is also called a page-wide head. The specified recording resolution may be recording resolution determined in advance by the inkjet printing apparatus 201 or may be the recording resolution set by automatic selection by selection of the user or by a program according to a print mode. The recording resolution can be 1200 dpi, for example. The sheet width direction orthogonal to the conveyance direction of the sheet P is called a nozzle row direction of the line head, and the conveyance direction of the sheet P is called a nozzle-row perpendicular direction in some cases.

In the case of the inkjet head having the two-dimensional nozzle alignment, a projection nozzle row obtained by projecting (orthogonal projection) each nozzle in the two-dimensional nozzle alignment so that they are aligned along the nozzle row direction can be considered equivalent to a one row of the nozzle row in which each of the nozzles is aligned at a substantially equal interval with such nozzle density that the maximum recording resolution is achieved with respect to the nozzle row direction. The phrase "substantially equal interval" means a substantially equal interval as ejection points recordable by the inkjet printing apparatus. For example, even if those at a slightly different interval, considering a manufacturing error and/or movement of a droplet on the medium caused by landing interference or the like are included, they are included in a concept of the "equal interval". The projection nozzle row corresponds to a substantial nozzle row. Considering the projection nozzle row, nozzle numbers indicating nozzle positions can be associated with each of the nozzles in the order of alignment of the projection nozzles aligned along the nozzle row direction.

An alignment form of the nozzles in each of the inkjet heads 246C, 246M, 246Y, and 246K is not limited, but various forms of the nozzle alignment can be employed. For example, instead of the two-dimensional alignment form in a matrix state, one-row linear alignment, V-shaped nozzle alignment, polygonal nozzle alignment such as a W-shape with a repetition unit of the V-shaped alignment can be used.

Toward the sheet P conveyed by the drawing drum 242, the ink droplet is ejected from the inkjet heads 246C, 246M, 246Y, and 246K, and the ejected droplet adheres to the sheet P, and an image is recorded on the sheet P.

The drawing drum 242 functions as a device of relatively moving the inkjet heads 246C, 246M, 246Y, and 246K and the sheet P. The drawing drum 242 relatively moves the sheet P with respect to the inkjet heads 246C, 246M, 246Y, and 246K and corresponds to one form of a relative moving device. Ejection timing of each of the inkjet heads 246C, 246M, 246Y, and 246K is synchronized with a rotary encoder signal obtained from a rotary encoder installed on the drawing drum 242. Illustration of the rotary encoder in FIG. 27 is omitted and is described as the rotary encoder 382 in FIG. 28. The ejection timing is timing of ejecting the ink droplet and has the same meaning as the ejection timing.

In this example, constitution of standard colors (4 colors) of CMYK is exemplified, but a combination of ink colors and color numbers is not limited to this embodiment, and thin ink, thick ink, special ink and the like may be added as necessary. For example, constitution of adding an inkjet head ejecting light-color ink such as light cyan, light magenta and the like or constitution of adding an inkjet head ejecting ink in special color such as green or orange can be employed, for example, and alignment order of the ink-jet heads in each of the colors is not particularly limited.

The in-line scanner 248 is an image reading unit reading an image recorded on the sheet P by the inkjet heads 246C, 246M, 246Y, and 246K. The in-line scanner 248 is constituted by using a CCD line sensor, for example.

Based on data of a read-out image read out by the in-line scanner 248, abnormality of the image is detected. Moreover, based on data of the read-out image read out by the in-line scanner 248, information on image density or defective ejection of the inkjet heads 246C, 246M, 246Y, and 246K is obtained.

The ink drying unit 250 applies drying processing to the sheet P on which the image is recorded by the drawing unit 240. The ink drying unit 250 includes a chain delivery 310, a sheet guide 320, and a hot-air blowing unit 330.

The chain delivery 310 receives the sheet P from the drawing drum 242 and transfers the received sheet P to the integrating unit 260. The chain delivery 310 includes a pair of endless chains 312 running on specified running paths and conveys the sheet P along the specified conveyance path while gripping the leading edge portion of the sheet P by grippers 314 provided in the pair of chains 312. The grippers 314 are provided in plural at a certain interval in the chain 312.

The sheet guide 320 is a member guiding conveyance of the sheet P by the chain delivery 310. The sheet guide 320 is constituted by a first sheet guide 322 and a second sheet guide 324. The first sheet guide 322 guides the sheet P conveyed in a first conveyance section of the chain delivery 310. The second sheet guide 324 guides the sheet conveyed in a second conveyance section on a rear of the first conveyance section. The hot-air blowing unit 330 blows hot air to the sheet P conveyed by the chain delivery 310.

The integrating unit 260 includes an integrating device 262 which receives a sheet P conveyed from the ink drying unit 250 by the chain delivery 310 and integrates it.

The chain delivery 310 releases the sheet P at a predetermined integrated position. The integrating device 262 includes an integrating tray 262A, receives the sheet P released from the chain delivery 310 and integrates them in a bundled state on the integrating tray 262A. The integrating device corresponds to a discharge unit.

[Outline of System Constitution]

Figure 28:
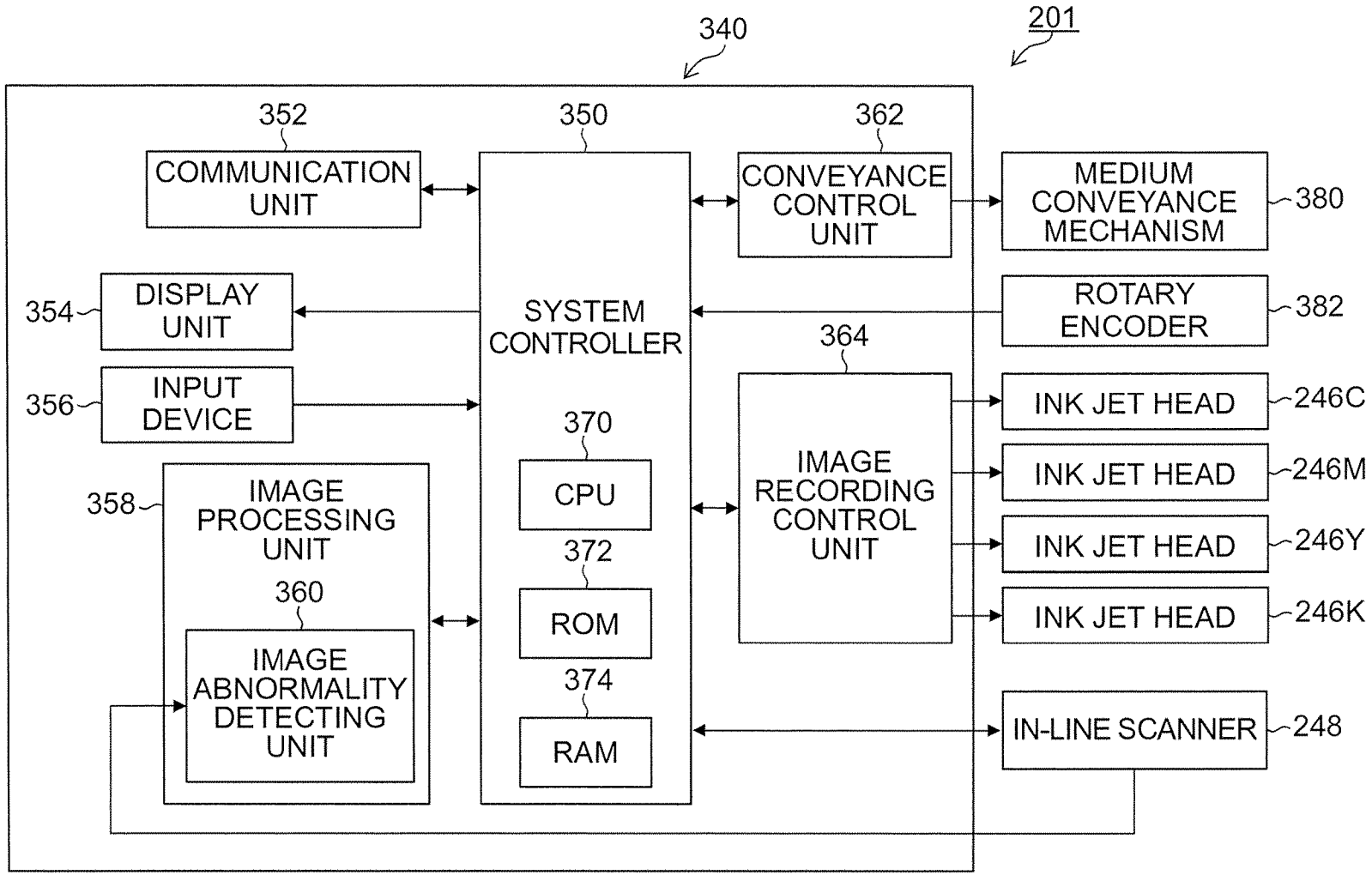
FIG. 28 is a block diagram illustrating constitution of an essential part of a control system of the inkjet printing apparatus.

FIG. 28 is a block diagram illustrating constitution of an essential part of a control system of the inkjet printing apparatus 201. The inkjet printing apparatus 201 is controlled by a controller 340. The controller 340 includes a system controller 350, a communication unit 352, a display unit 354, an input device 356, an image processing unit 358, a conveyance control unit 362, and an image recording control unit 364. Elements of each unit in the controller 340 can be realized by a single or a plurality of computers.

The system controller 350 functions as a control device integrally controlling each unit of the inkjet printing apparatus 201 and also functions as a calculating device performing various types of calculation processing. The system controller 350 includes a CPU (Central Processing Unit) 370, a ROM (read-only memory) 372, and a RAM (random access memory) 374 and operates in accordance with a predetermined control program. The ROM 372 stores a program executed by the system controller 350 and various types of data required for control.

The communication unit 352 includes a required communication interface. The inkjet printing apparatus 201 is connected to a host computer, not shown, through the communication unit 352 and can transmit/receive data with the host computer. The "connection" here includes wired connection, wireless connection or a combination thereof. On the communication unit 352, a buffer memory for speeding up communication may be mounted.

The communication unit 352 plays a role of an image input interface unit which obtains image data expressing an image to be printed.

The display unit 354 and the input device 356 constitute a user interface. For the input device 356, various input devices such as a keyboard, a mouse, a touch panel, a track ball or the like may be employed or it may be an appropriate combination of them. Such a form can be employed that the display unit 354 and the input device 356 are integrally constituted as constitution disposed on the touch panel on a screen of the display unit 354.

The operator can perform input of various types of information such as input of a print condition, selection of an image quality mode, input of other setting matters, input and editing of accessory information, search of information and the like by using the input device 356 while viewing the contents displayed on the display unit 354. Moreover, the operator can confirm the other various types of information such as input contents through display of the display unit 354. The display unit 354 functions as an error information notifying device which notifies error information. For example, if a streak defect is detected from a printed matter, streak defect detection information indicating detection information of the streak defect is displayed on the screen of the display unit 354.

The image processing unit 358 includes an image abnormality detecting unit 360. The image abnormality detecting unit 360 performs processing of detecting abnormality of an image by analyzing a read-out image obtained from the in-line scanner 248. Moreover, the image processing unit 358 performs various types of conversion processing, correction processing and halftone processing to the image data to be printed. The conversion processing includes pixel number conversion, gradation conversion, color conversion and the like. The correction processing includes density correction or non-ejection correction for suppressing visibility of an image defect by the non-ejection nozzle.

The image processing unit 358 may be configured by a computer different from the controller including the system controller 350 or may be configured by being included as a functional block in the controller including the system controller 350.

The conveyance control unit 362 controls a medium conveyance mechanism 380. The medium conveyance mechanism 380 includes the whole of a mechanism of a sheet conveying unit relating to conveyance of the sheet P from the sheet feeding unit 210 to the integrating unit 260 illustrated in FIG. 27. The medium conveyance mechanism 380 includes the sheet feeding drum 216, the treatment liquid application drum 222, the treatment liquid drying drum 232, the drawing drum 242, the chain delivery 310 and the like illustrated in FIG. 27. The medium conveyance mechanism 380 includes a driving unit such as a motor and a motor driving circuit as a power source, not shown.

The conveyance control unit 362 controls the medium conveyance mechanism 380 and performs control so that the sheet P is conveyed without a delay from the sheet feeding unit 210 to the integrating unit 260 in accordance with an instruction from the system controller 350.

The inkjet printing apparatus 201 includes the rotary encoder 382 as a device of detecting a rotation angle of the drawing drum 242 (see FIG. 27) in the medium conveyance mechanism 380. Each of the inkjet heads 246C, 246M, 246Y, and 246K has its ejection timing controlled in accordance with an ejection timing signal generated from a rotary encoder signal output by the rotary encoder 382.

The image recording control unit 364 controls driving of each of the inkjet heads 246C, 246M, 246Y, and 246K in accordance with an instruction from the system controller 350. The image recording control unit 364 controls an ejection operation of each of the inkjet heads 246C, 246M, 246Y, and 246K so that a predetermined image is recorded on the sheet P conveyed by the drawing drum 242 based on dot data in each ink color generated via the halftone processing of the image processing unit 358.

Figure 29:
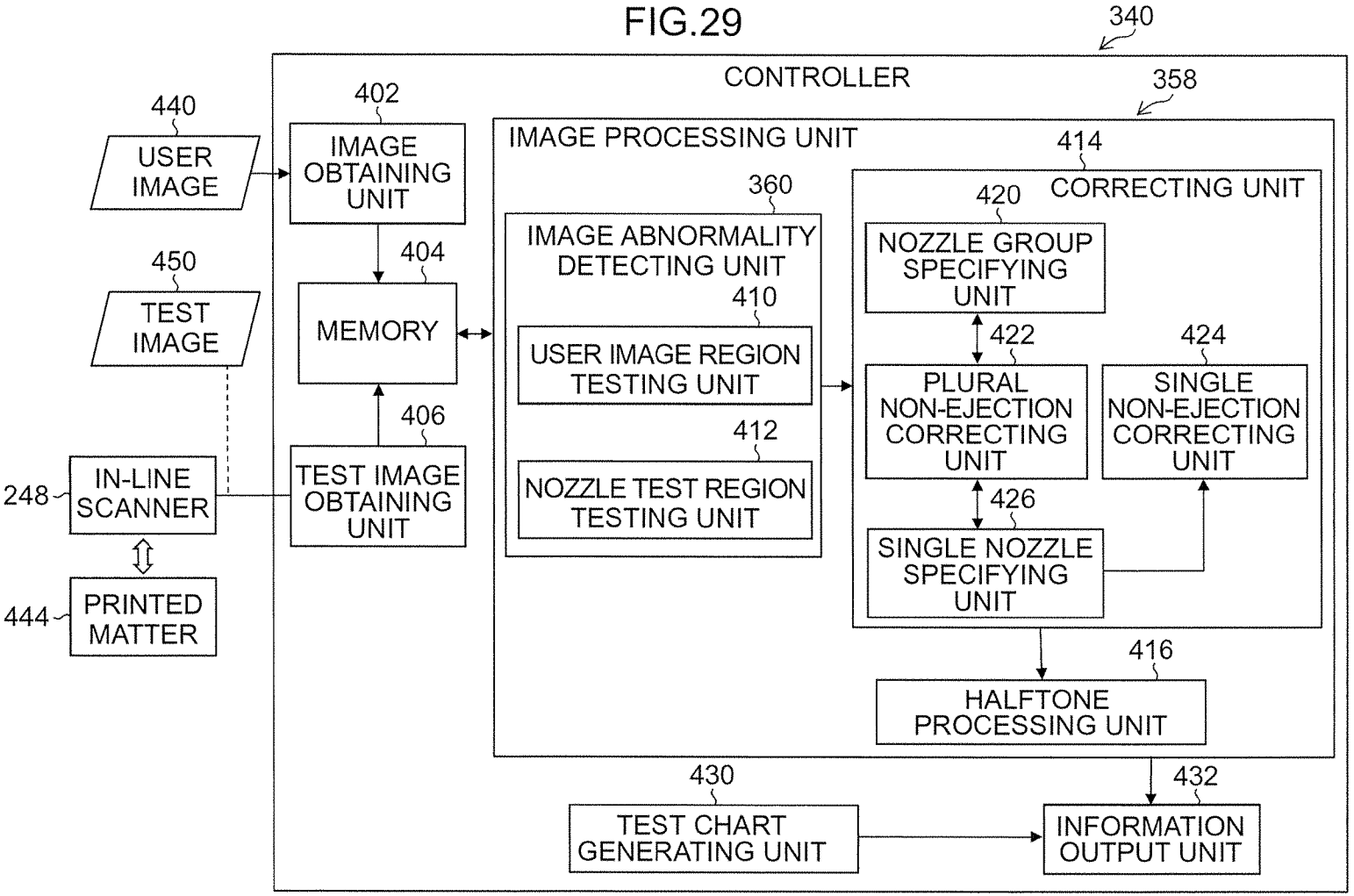
FIG. 29 is a block diagram illustrating main constitution relating to an image testing function and an image correcting function of a controller.

FIG. 29 is a block diagram illustrating main constitution relating to an image testing function and an image correcting function of the controller 340. The controller 340 can carry out the image correcting method by any one of the first example to the fifth example having been already described or an appropriate combination of them.

The controller 340 includes an image obtaining unit 402, a memory 404, and a test image obtaining unit 406 in addition to the image processing unit 358. The image obtaining unit 402 is an interface which takes in data of a user image 440 to be printed from outside the device or from other circuits in the device. The communication unit 352 described in FIG. 28 can function as the image obtaining unit 402.

The test image obtaining unit 406 is an interface which takes in data of a test image 450 from outside of the device or from other circuits in the device. In the case of this embodiment, the test image 450 is an image obtained by imaging a printed matter 444 printed by the inkjet printing apparatus 201 by the in-line scanner 248.

The memory 404 is a storage unit which stores the user image 440 obtained through the image obtaining unit 402. The memory 404 is a storage unit which stores the test image 450 obtained through the test image obtaining unit 406. The memory 404 can function as a work memory when various calculations of the image processing unit 358 are carried out.

The image abnormality detecting unit 360 of the image processing unit 358 is constituted by including a user image region testing unit 410 and a nozzle test region testing unit 412.

The user image region testing unit 410 carries out processing of testing abnormality of a user image printed on the user image region 82. The nozzle test region testing unit 412 carries out processing of testing a test chart printed on the nozzle test region 84.

The image processing unit 358 includes a correcting unit 414 and a halftone processing unit 416. The correcting unit 414 performs correction processing of making a streak invisible based on a detection result by the image abnormality detecting unit 360. The correcting unit 414 is constituted by including a nozzle group specifying unit 420, a plural non-ejection correcting unit 422, a single non-ejection correcting unit 424, and a single nozzle specifying unit 426.

The nozzle group specifying unit 420 carries out processing of specifying a nozzle group including an abnormal nozzle. The nozzle group specifying unit 420 specifies in which a nozzle group an abnormal nozzle is included in a plurality of nozzle groups different from each other. The plural non-ejection correcting unit 422 carries out processing required for correction in the plural non-ejection correction mode. The plural non-ejection correcting unit 422 carries out processing of making the nozzle group non-ejectable and processing of correcting a signal of a pixel corresponding to the non-ejection correction nozzle compensating for inability of recording caused by non-ejection. The plural non-ejection correcting unit 422 can carry out plural non-ejection correction of correcting by making a part of nozzle groups non-ejectable in a plurality of nozzle groups belonging to a nozzle range corresponding to a region including abnormality detected by the image abnormality detecting unit 360.

The single non-ejection correcting unit 424 carries out processing required for correction in the single non-ejection correction mode. The single non-ejection correcting unit 424 carries out processing of making an abnormal nozzle specified by the single nozzle specifying unit 426 non-ejectable and processing of correcting a signal of a pixel corresponding to the non-ejection correction nozzle compensating for inability of recording caused by non-ejection. The single nozzle specifying unit 426 carries out processing of specifying an abnormal nozzle.

The halftone processing unit 416 carries out processing of converting an image signal corrected by the correcting unit 414 to binary or multi-value dot data by quantization.

Moreover, the controller 340 includes a test chart generating unit 430 and an information output unit 432. The test chart generating unit 430 can generate data for print of at least one test chart in a chart 70 for calculating a single non-ejection correction parameter described in FIG. 7, a chart 74 for calculating a plural non-ejection correction parameter described in FIG. 8, a nozzle test pattern 86 described in FIG. 9, a test chart used in a second nozzle testing method, and a chart for specifying nozzle group described in FIG. 17.

The information output unit 432 is an output interface which outputs information generated in the controller 340. The information output unit 432 may output information to other processing unit and the like in the controller 340 or may output information to an outside of the controller 340.

The data for print of the test chart generated by the test chart generating unit 430 is sent to the image recording control unit 364 (see FIG. 28) through the information output unit 432. The test chart generating unit 430 illustrated in FIG. 29 is an example of a test chart generating device. A combination of the test chart generating unit 430 and the image recording control unit 364 (see FIG. 28) is an example of the test chart output control device.

The data for print by dot data generated by the halftone processing unit 416 is sent to the image recording control unit 364 (see FIG. 28) through the information output unit 432. A combination of the correcting unit 414 illustrated in FIG. 29 and the image recording control unit 364 (see FIG. 28) corresponds to one form of a correcting device.

A combination of the plural non-ejection correcting unit 422 and the image recording control unit 364 corresponds to one form of the plural non-ejection correcting device. A combination of the single non-ejection correcting unit 424 and the image recording control unit 364 corresponds to one form of the single non-ejection correcting device. The nozzle group specifying unit 420 corresponds to one form of the nozzle-group specifying device. The single nozzle specifying unit 426 corresponds to one form of a single nozzle specifying device.

A combination of the test chart generating unit 430, the image recording control unit 364, and the image abnormality detecting unit 360 corresponds to one form of an image abnormality detecting device.

Advantages of Embodiment (1) According to the embodiment of this disclosure, when abnormality of an image caused by abnormality of a nozzle is detected, correction in the plural non-ejection correction mode is carried out in an early stage to the nozzle group including the abnormal nozzle. As a result, generation of a waste sheet can be suppressed.

(2) According to this embodiment of this disclosure, since the abnormal nozzle is specified and the mode proceeds to the single non-ejection correction mode after generation of a waste sheet is suppressed by the plural non-ejection correction mode, correction can be carried out with fewer waste sheets even in system constitution requiring time for specifying an abnormal nozzle.

(3) According to the embodiment of this disclosure, even if a scanner with low resolution is used, correction can be carried out with fewer waste sheets, the abnormal nozzle specified, and a streak made invisible.

[Variation 1]

In the aforementioned embodiment, such a form is exemplified that a non-ejection correction parameter is applied to the image data before the halftone processing and a signal value is corrected, and the image data after the correction is subjected to the halftone processing, but when the invention is put into practice, constitution of correcting data after the halftone processing may be employed. Moreover, a driving signal to be applied to an ejection energy generating element of each nozzle may be corrected.

[Variation 2]

In the constitution exemplified in FIG. 29, the correcting unit 414 includes the nozzle group specifying unit 420 and the single nozzle specifying unit 426 but each of the nozzle group specifying unit 420 and the single nozzle specifying unit 426 may be provided separately from the correcting unit. A form in which a processing unit in charge of an image testing function of the image abnormality detecting unit 360 and a processing unit in charge of the correcting processing function of the correcting unit 414 are constituted as separate signal processing device may be employed. A function of the controller 340 may be realized by a combination of a plurality of controllers and signal processing devices.

[Variation 3]

In the aforementioned embodiment, the X-direction orthogonal to the conveyance direction of the recording medium is described as one example of the "second direction", but the second direction only needs to be a direction crossing the first direction which is a relative movement direction. The term "orthogonal" or "perpendicular" in this Description includes a mode which generates a working effect similar to the case of crossing substantially forming an angle of 90° in modes of crossing forming an angle less than 90° or crossing forming an angle exceeding 90°.

Combination of Embodiment and Variations and the Like

The matters described in the constitution or variations described in the aforementioned embodiment can be used in combination as appropriate or a part of the matters can be replaced.

[Conveying Device of Recording Medium]

A conveying device which conveys a recording medium is not limited to a drum conveying method exemplified in FIG. 27, but various forms such as a belt conveyance method, a nip conveyance method, a chain conveyance method, a pallet conveyance method and the like may be employed or these methods can be combined as appropriate.

[Recording Medium]

The term recording medium or a medium used in recording of an image is a collective name for media called by many terms such as a sheet, a recording sheet, a printing sheet, a printing medium, a print medium, a medium to be printed, an image forming medium, a medium on which an image is formed, an image receiving medium, a medium to be deposited on and the like. A material, a shape and the like of the sheet is not particularly limited and various sheet bodies such as a seal sheet, a resin sheet, a film, a cloth, a non-woven cloth or those in any material or shape can be used. A paper sheet is not limited to a cut sheet shaped in advance to a standard size but may be obtained at any time by cutting continuous paper to the standard size.

The term "image" should be interpreted in a wide sense and includes a color image, a black-and-white image, a single-colored image, a gradation image, a (solid) image with uniform density and the like. The term "image" is not limited to a photo image but is used as a comprehensive term including a pattern, a character, a symbol, a drawing, a mosaic pattern, a pattern painted in each color and other various patterns or an appropriate combination of them. The phrase "recording of an image" includes concepts of terms such as formation of an image, printing, print, drawing and the like.

[Ejection Method]

An ejector of the inkjet head is constituted by including a nozzle which ejects a liquid, a pressure chamber communicating with the nozzle, and an ejection energy generating element which applies ejection energy to the liquid in the pressure chamber. Regarding an ejection method for ejecting a droplet from the nozzle of the ejector, a device which generates ejection energy is not limited to a piezoelectric element but various ejection energy generating elements such as a heat element, an electrostatic actuator and the like can be applied. For example, a method of ejecting a droplet by using a pressure of Win boiling by heating of the liquid by the heat element can be employed. In accordance with the ejection method of the liquid ejection head, an appropriate ejection energy generating element is provided in a channel structural body.

The embodiment of the present invention described above is capable of changing, adding or deleting constituent requirement as appropriate within a range not departing from the gist of the present invention. The present invention is not limited to the embodiment described above but is capable of many variations by those having ordinary knowledge in the field within a technical idea of the present invention.

What is claimed is:

1. An image forming apparatus comprising:

an inkjet head having a plurality of nozzles each ejecting a droplet;

an image abnormality detecting device configured to detect abnormality of an image caused by abnormality of a nozzle of the plurality of nozzles from the image recorded on a recording medium by the inkjet head; and a correcting device configured to perform correction of lowering visibility of a missing portion by making a part of the plurality of nozzles non-ejectable and by compensating for the missing portion in the recorded image caused by the non-ejection by recording from another nozzle based on a detection result by the image abnormality detecting device, wherein:

the correcting device includes:

a plural non-ejection correcting device configured to perform a plural non-ejection correction by making two or more of the nozzles non-ejectable with respect to one abnormal nozzle; and a single non-ejection correcting device configured to perform a single non-ejection correction by making one abnormal nozzle non-ejectable with respect to the one abnormal nozzle, and wherein a controller of the image forming apparatus is configured to determine whether the one abnormal nozzle is specified, in response to the one abnormal nozzle is specified, the single non-ejection correction is performed by the single non-ejection correcting device, in response to the one abnormal nozzle is not specified, the plural non-ejection correction is performed by the plural non-ejection correcting device, and after the plural non-ejection correction is performed that carries out correction by making a nozzle group belonging to a nozzle range corresponding to a region including the abnormality detected by the image abnormality detecting device and including the abnormal nozzle non-ejectable by the plural non-ejection correcting device, the single non-ejection correction is performed which carries out correction by making the abnormal nozzle non-ejectable by the single non-ejection correcting device.

2. The image forming apparatus according to claim 1, wherein a nozzle alignment direction in the inkjet head crossing a first direction that is a relative movement direction of the inkjet head and the recording medium when the image is to be recorded on the recording medium by the inkjet head is a second direction, the plural non-ejection correcting device performs correction by making a plurality of nozzles that are in an alignment order in the second direction of the nozzles non-ejectable and by lowering the visibility of the missing portion by using remaining nozzles other than the nozzles made non-ejectable.

3. The image forming apparatus according to claim 2, wherein when an integer nozzle number is given to each nozzle in accordance with an alignment order in the second direction of the nozzles in correspondence with a position of the nozzle in the second direction, the plural non-ejection correcting device is configured to make every other nozzle of the nozzles non-ejectable in the second direction and has an even-number nozzle group non-ejection correction mode in which a correction is performed by making the nozzle group with even nozzle numbers non-ejectable and an odd-number nozzle group non-ejection correction mode in which a correction is performed by making the nozzle group with odd nozzle numbers non-ejectable.

4. The image forming apparatus according to claim 1, further comprising:

a nozzle group specifying device configured to specify a nozzle group including the abnormal nozzle; and a single nozzle specifying device configured to specify one abnormal nozzle, wherein the plural non-ejection correction is performed to the nozzle group specified by the nozzle-group specifying device, and the single non-ejection correction is performed to the abnormal nozzle specified by the single nozzle specifying device.

5. The image forming apparatus according to claim 4, wherein after the plural non-ejection correction is performed by the plural non-ejection correcting device or while the plural non-ejection correction is being performed, the abnormal nozzle is specified by the single nozzle specifying device.

6. The image forming apparatus according to claim 5, wherein while the plural non-ejection correction is being performed by the plural non-ejection correcting device, processing of specifying the abnormal nozzle is executed by the single nozzle specifying device; and when the abnormal nozzle is specified, the plural non-ejection correction is switched to the single non-ejection correction by the single non-ejection correcting device.

7. The image forming apparatus according to claim 4, wherein the nozzle group specifying device specifies in which nozzle group the abnormal nozzle is included in a plurality of the nozzle groups different from each other.

8. The image forming apparatus according to claim 7, wherein the nozzle-group specifying device specifies the nozzle group including the abnormal nozzle by changing a nozzle group which is to be made non-ejectable by the plural non-ejection correcting device and by analyzing an image obtained by performing the correction by the plural non-ejection correcting device.

9. The image forming apparatus according to claim 7, wherein the nozzle-group specifying device specifies the nozzle group including the abnormal nozzle based on a first test chart recorded for each nozzle group.

10. The image forming apparatus according to claim 7, further comprising a plurality of the inkjet heads having different colors of ink to be ejected, wherein the plurality of nozzle groups different from each other include those with different colors of ink to be ejected among the nozzle groups.

11. The image forming apparatus according to claim 4, wherein the single nozzle specifying device records a second test chart for specifying the abnormal nozzle on a nozzle test region provided outside a user image region of the recording medium and specifies the abnormal nozzle based on a recording result of the second test chart.

12. The image forming apparatus according to claim 4, wherein the single nozzle specifying device specifies the abnormal nozzle by sequentially cancelling non-ejection of the non-ejection nozzle that has been made non-ejectable in the plural non-ejection correction by the plural non-ejection correcting device one by one and by detecting abnormality of the image after the respective correction.

13. The image forming apparatus according to claim 4, wherein if specification of the abnormal nozzle by the single nozzle specifying device is not possible, a correction by the plural non-ejection correcting device is cancelled.

* * * * *